US009134667B2

(12) United States Patent
Ono

(10) Patent No.: US 9,134,667 B2
(45) Date of Patent: Sep. 15, 2015

(54) FIXING APPARATUS HAVING COOLING DEVICE FOR PRESSURE ROLLER

(71) Applicant: CANON KABUSHIKI KAISHA, Tokyo (JP)

(72) Inventor: Kazuaki Ono, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/942,552

(22) Filed: Jul. 15, 2013

(65) Prior Publication Data

US 2014/0023389 A1 Jan. 23, 2014

(30) Foreign Application Priority Data

Jul. 18, 2012 (JP) ..... 2012-159458

(51) Int. Cl.
*G03G 15/20* (2006.01)

(52) U.S. Cl.
CPC ..... *G03G 15/2078* (2013.01); *G03G 15/2017* (2013.01); *G03G 15/2039* (2013.01); *G03G 15/2042* (2013.01)

(58) Field of Classification Search
CPC ..... G03G 15/2017; G03G 15/2042; G03G 15/2078
USPC ..... 399/69, 92, 334
See application file for complete search history.

(56) References Cited

U.S. PATENT DOCUMENTS

| | | | | |
|---|---|---|---|---|
| 5,550,621 | A * | 8/1996 | Ogawahara | 399/69 |
| 5,787,321 | A * | 7/1998 | Nishikawa et al. | 399/69 |
| 5,991,565 | A * | 11/1999 | Hanyu et al. | 399/69 |
| 6,385,410 | B1 * | 5/2002 | Hanyu et al. | |
| 7,106,986 | B2 * | 9/2006 | Nakayama | 399/69 |
| 2001/0048822 | A1 * | 12/2001 | Hanyu et al. | |
| 2004/0190925 | A1 * | 9/2004 | Baruch et al. | 399/69 |
| 2006/0140662 | A1 * | 6/2006 | Nagase | 399/92 |
| 2006/0177250 | A1 * | 8/2006 | Nakagaki | |

FOREIGN PATENT DOCUMENTS

JP 2010-181468 A 8/2010

* cited by examiner

*Primary Examiner* — Walter L Lindsay, Jr.
*Assistant Examiner* — Milton Gonzalez
(74) *Attorney, Agent, or Firm* — Canon U.S.A., Inc. IP Division

(57) ABSTRACT

A fixing apparatus that fixes a toner image on a sheet includes each of fans configured to respectively cool areas adjacent to a longitudinal center and longitudinal both ends of a pressure roller, and in a case where fixing processing is performed on thin paper of a maximum width size, includes a first mode in which the fixing processing is started after the fan configured to cool the area adjacent to the longitudinal center of the pressure roller is actuated for a predetermined time and a second mode in which the fixing processing is started after the fan configured to cool the area adjacent to the longitudinal both ends of the pressure roller is actuated for a predetermined time.

5 Claims, 12 Drawing Sheets

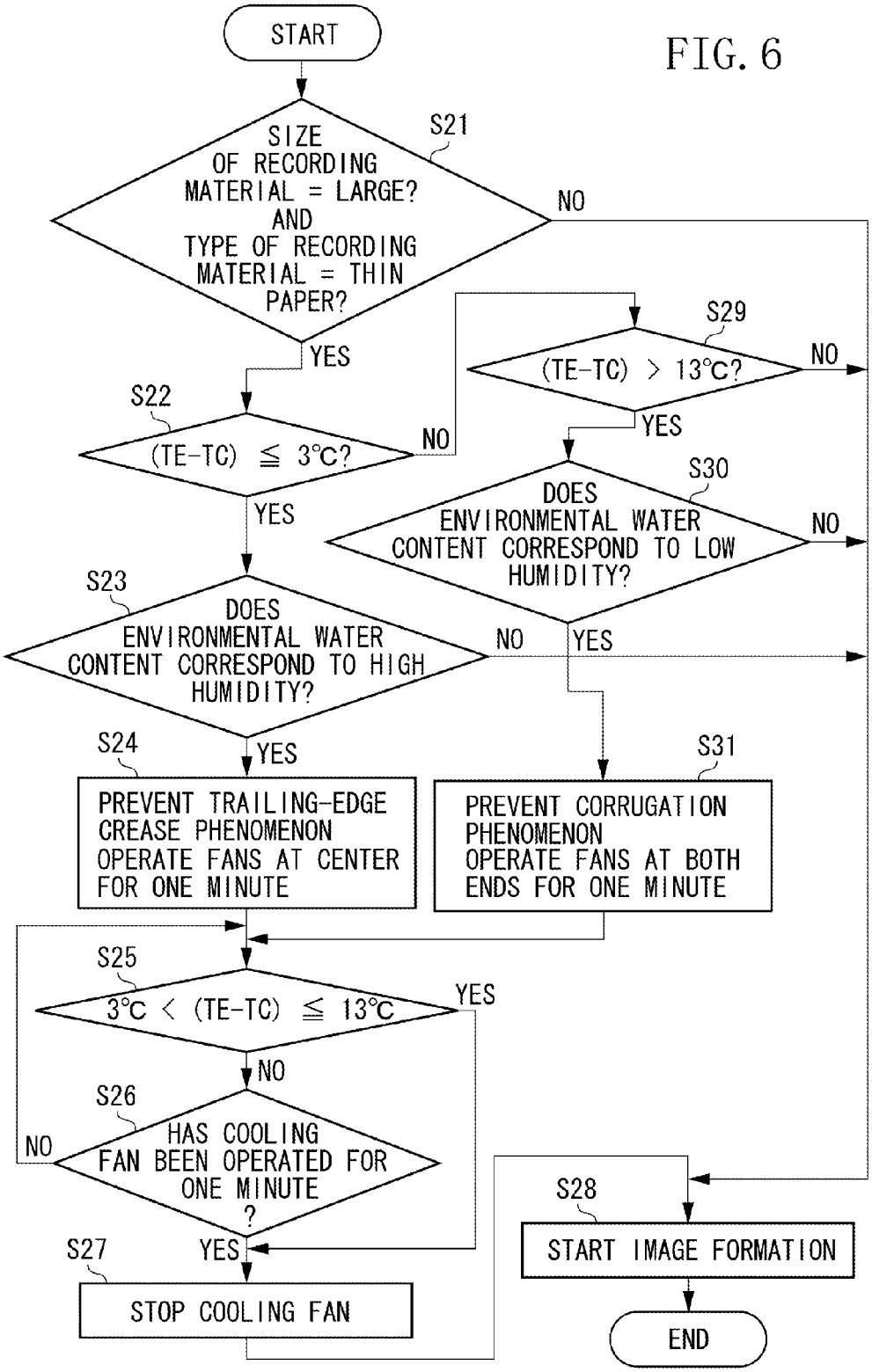
FIG. 6
START
S21
SIZE OF RECORDING MATERIAL = LARGE? AND TYPE OF RECORDING MATERIAL = THIN PAPER?
NO
YES
S22
(TE-TC) ≦ 3°C?
NO
YES
S29
(TE-TC) > 13°C?
NO
YES
S30
DOES ENVIRONMENTAL WATER CONTENT CORRESPOND TO LOW HUMIDITY?
NO
YES
S23
DOES ENVIRONMENTAL WATER CONTENT CORRESPOND TO HIGH HUMIDITY?
NO
YES
S24
PREVENT TRAILING-EDGE CREASE PHENOMENON OPERATE FANS AT CENTER FOR ONE MINUTE
S31
PREVENT CORRUGATION PHENOMENON OPERATE FANS AT BOTH ENDS FOR ONE MINUTE
S25
3°C < (TE-TC) ≦ 13°C
YES
NO
S26
HAS COOLING FAN BEEN OPERATED FOR ONE MINUTE ?
NO
YES
S27
STOP COOLING FAN
S28
START IMAGE FORMATION
END

DURING MEASURES AGAINST CORRUGATION

DURING MEASURES AGAINST TRAILING-EDGE CREASE PHENOMENON

OVERALL VIEW

ENLARGED VIEW

OVERALL VIEW

ENLARGED VIEW

FIXING APPARATUS HAVING COOLING DEVICE FOR PRESSURE ROLLER

BACKGROUND OF THE INVENTION

1. Field of the Invention

The present invention relates to a fixing apparatus that fixes a toner image on a sheet.

2. Description of the Related Art

Conventionally, a fixing apparatus has been required to improve a conveyance characteristic of a recording material (sheet).

Therefore, a fixing apparatus discussed in Japanese Patent Application Laid-Open No. 2010-181468 cools a center in a longitudinal direction of a pressure roller with a cooling fan before starting image formation on the first recording material, to start the image formation on the first recording material after waiting until the center in the longitudinal direction of the pressure roller becomes lower by a predetermined temperature than both ends thereof. This is to prevent a crease from occurring at a trailing edge of the recording material (see FIGS. 11A and 11B).

However, in the fixing apparatus discussed in Japanese Patent Application Laid-Open No. 2010-181468, a temperature adjacent to both ends in the longitudinal direction of the pressure roller is made higher than a temperature at the longitudinal center thereof. Therefore, the recording material may be corrugated under a certain situation (condition) (see FIGS. 12A and 12B).

SUMMARY OF THE INVENTION

According to an aspect of the present invention, a fixing apparatus includes a heating rotary member and a pressing rotary member configured to fix a toner image on a sheet in a nip portion therebetween, a first cooling device configured to cool an area adjacent to a longitudinal center of the pressing rotary member, a second cooling device configured to cool an area adjacent to longitudinal ends of the pressing rotary member, and a selecting device configured to, in a case where fixing processing is performed on a sheet having a maximum width usable for the fixing apparatus and having a basis weight of less than a predetermined value, select one of a plurality of modes including a first mode in which the fixing processing is started after the first cooling device is actuated for a predetermined time and a second mode in which the fixing processing is started after the second cooling device is actuated for a predetermined time.

Further features and aspects of the present invention will become apparent from the following description of exemplary embodiments with reference to the attached drawings.

BRIEF DESCRIPTION OF THE DRAWINGS

FIG. 6 is a flowchart of cooling control of a pressure roller in the second exemplary embodiment.

DESCRIPTION OF THE EMBODIMENTS

Various exemplary embodiments, features, and aspects of the invention will be described in detail below with reference to the drawings. Unless otherwise noted, entire or a portion of an exemplary embodiment described below may be substituted by an alternative configuration within the scope of the present invention.

While a printer will be described below as an example of an image forming apparatus, the present invention can be implemented in various types of applications such as a printing machine, a copying machine, a facsimile, and a multi-function peripheral by adding a required device, equipment, or housing structure thereto.

Image Forming Apparatus

Figure 1:
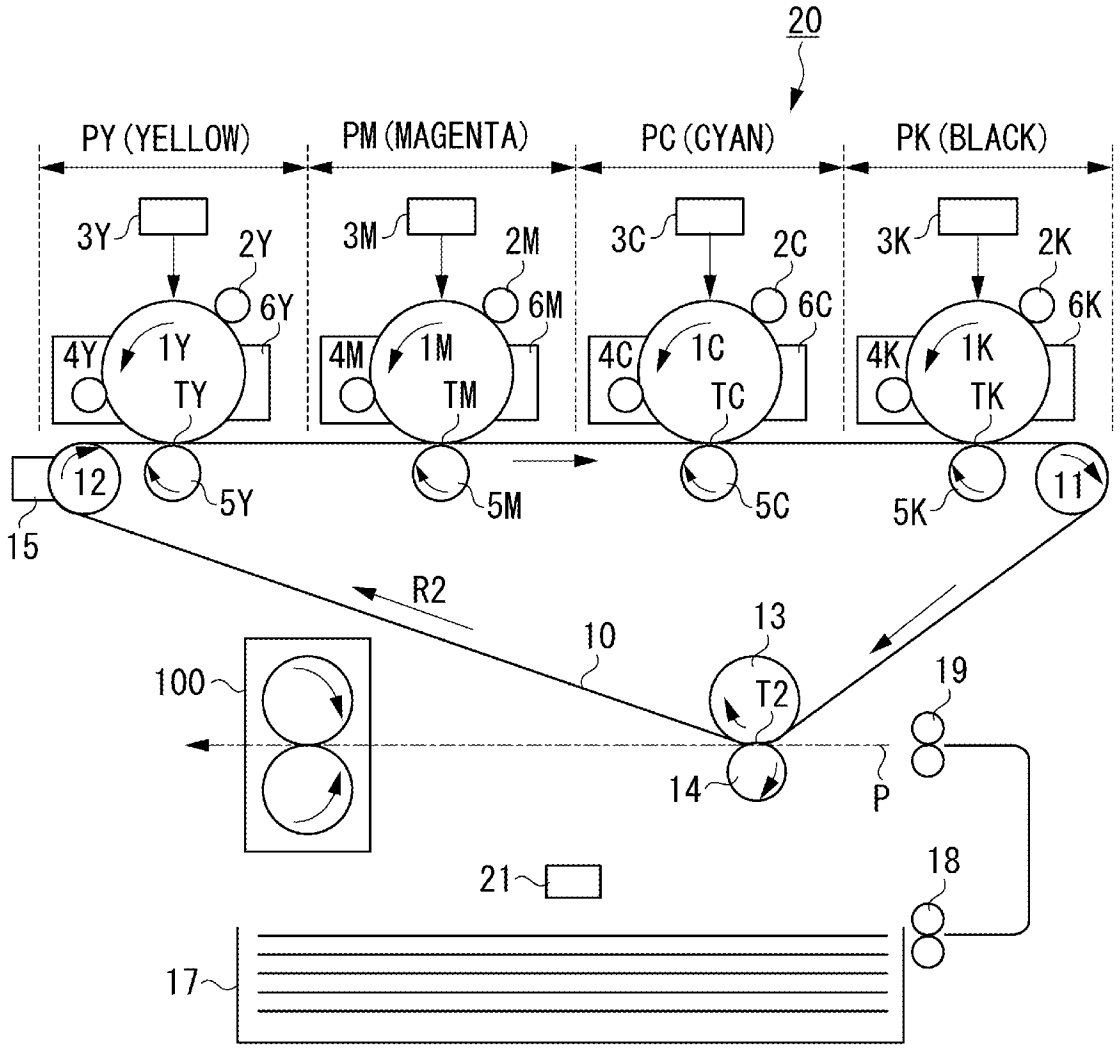
FIG. 1 illustrates a configuration of an image forming apparatus.

FIG. 1 illustrates a configuration of an image forming apparatus 20. As illustrated in FIG. 1, the image forming apparatus 20 is a full-color printer of a tandem intermediate transfer system including image-forming units PY, PM, PC, and PK arranged along an intermediate transfer belt 10.

In the image-forming unit PY, a yellow toner image is formed on a photosensitive drum 1Y, and is transferred onto the intermediate transfer belt 10. In the image-forming unit PM, a magenta toner image is formed on a photosensitive drum 1M, and is transferred onto the intermediate transfer belt 10. In the image forming units PC and PK, a cyan toner image and a black toner image are respectively formed on photosensitive drums 1C and 1K, and are transferred onto the intermediate transfer belt 10.

The toner images in the four colors, which have been transferred onto the intermediate transfer belt 10, are conveyed to a secondary transfer unit T2, and are secondarily transferred onto a recording material (sheet) P. A separation roller 18 separates recording materials P extracted from a recording material cassette 17 from one another, and sends one of the recording materials P to a registration roller 19. The registration roller 19 feeds the recording material P into the secondary transfer unit T2 to match the timing with the toner images on the intermediate transfer belt 10. The recording material P, on which the toner images in the four colors have been secondarily transferred by the secondary transfer unit T2, is curvature-separated from the intermediate transfer belt 10, and is conveyed to a fixing apparatus 100. The recording material P is discharged out of an apparatus body after the toner images have been fixed on its surface upon being heated and pressurized in the fixing apparatus 100.

The image forming units PY, PM, PC, and PK have substantially similar configurations except that the respective colors of toners used in developing devices 4Y, 4M, 4C, and 4K differ, i.e., yellow, magenta, cyan, and black. The image forming unit PY will be described below, and an overlapped description for the other image forming units PM, PC, and PK is not repeated.

The image forming unit PY includes a charging roller 2Y, an exposure device 3Y, a developing device 4Y, a transfer roller 5Y, and a drum cleaning device 6Y arranged around the photosensitive drum 1Y. The photosensitive drum 1Y has a photosensitive layer formed on an outer peripheral surface of its aluminum cylinder, and rotates in a direction indicated by an arrow at a predetermined process speed. The charging roller 2Y charges the photosensitive drum 1Y to a uniform negative-polarity dark portion potential Vd upon application of a vibration voltage obtained by superposing an alternating current (AC) voltage on a direct current (DC) voltage. The exposure device 3Y performs scanning with a laser beam obtained by on/off modulating scanning-line image data obtained by rasterizing a yellow separated-color image using a rotating mirror, and writes an electrostatic image onto a surface of the charged photosensitive drum 1Y. The developing device 4Y supplies the toner to the photosensitive drum 1Y, to develop the electrostatic image into a toner image.

The transfer roller 5Y primarily transfers the toner image borne on the photosensitive drum 1Y onto the intermediate transfer belt 10 upon application of a DC voltage. The drum cleaning device 6Y frictional slides a cleaning blade against the photosensitive drum 1Y, to recover the transfer residual toner, which has adhered to the surface of the photosensitive drum 1Y that has passed through a primary transfer unit TY.

The intermediate transfer belt 10 is stretched among a tension roller 12, a counter roller 13, and a drive roller 11 and supported thereon, and is driven by the drive roller 11, to rotate in a direction indicated by an arrow R2. A secondary transfer roller 14 abuts on the intermediate transfer belt 10 supported on the counter roller 13, to form the secondary transfer unit T2. A DC voltage is applied to the secondary transfer roller 14 so that the toner image borne on the intermediate transfer belt 10 is secondarily transferred onto the recording material P to be conveyed on the secondary transfer unit T2. A belt cleaning device 15 frictional slides the cleaning blade against the intermediate transfer belt 10, to recover the residual transfer toner that has adhered to the intermediate transfer belt 10.

The image forming apparatus 20 can execute a black monochrome mode (monochrome image formation) and a two or three color mode. In this case, image formation for the photosensitive drum is performed in the image forming unit in the necessary color, and the photosensitive drum idly rotes in the image forming unit in the unnecessary color.

Fixing Apparatus

Figure 2:
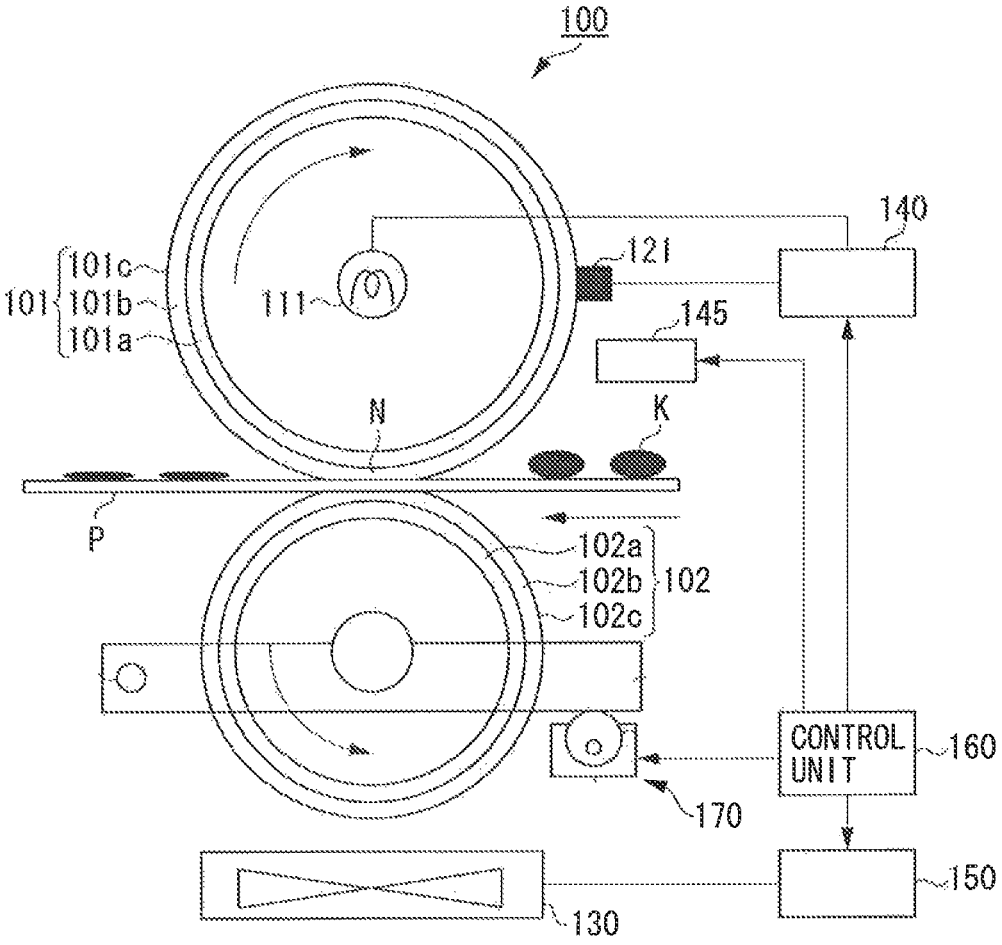
FIG. 2 illustrates a configuration of a fixing apparatus.
Figure 3:
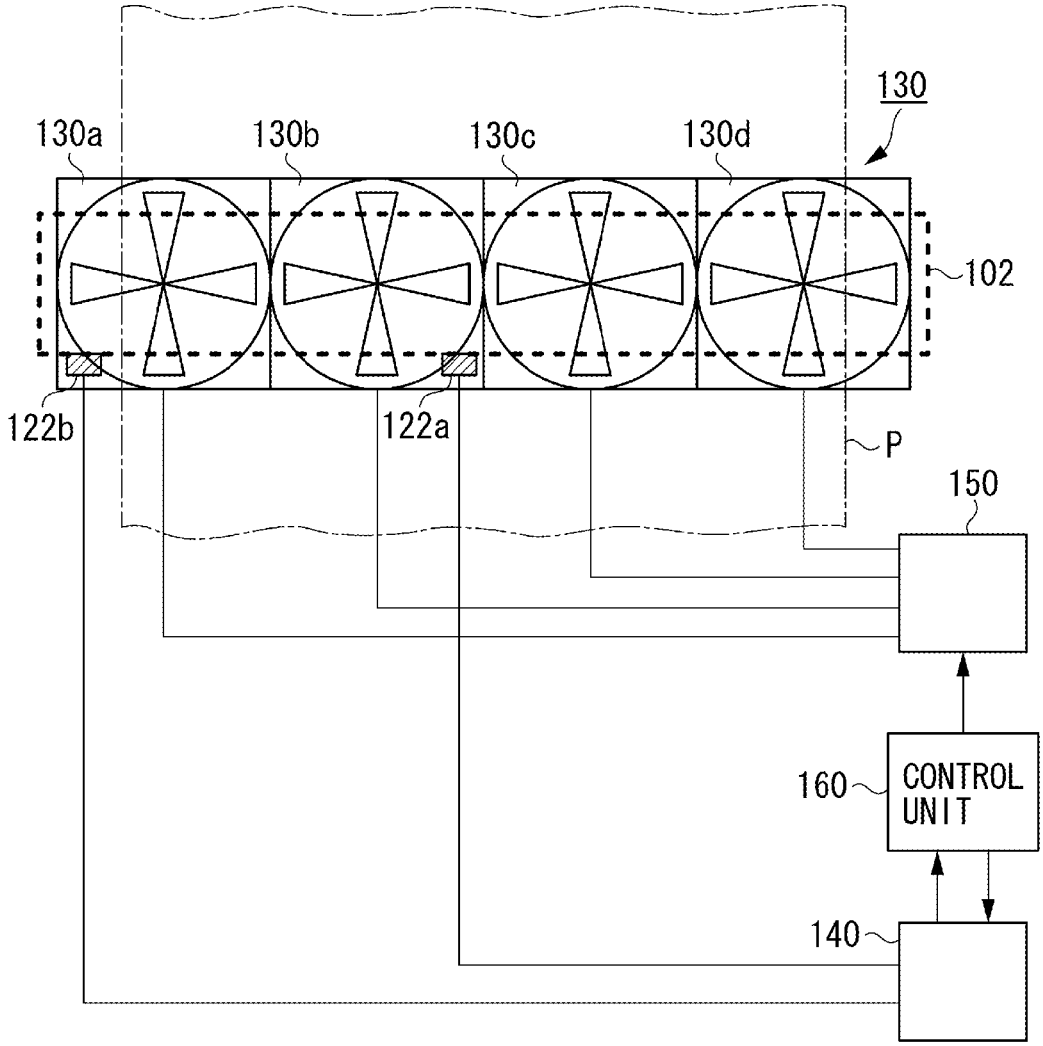
FIG. 3 illustrates an arrangement of a cooling device in an axial direction of a pressure roller.

FIG. 2 illustrates a configuration of the fixing apparatus 100. FIG. 3 illustrates an arrangement of a cooling device including a plurality of cooling fans arranged in a longitudinal direction of a pressure roller 102. As illustrated in FIG. 1, the fixing apparatus 100 fixes the toner images, which have been formed on the recording material P in the image forming units PY, PM, PC, and PK, onto the recording material P.

As illustrated in FIG. 2, the recording material P bearing the toner image is conveyed in a direction indicated by an arrow, and is guided into a nip portion N. The recording material P is heated and pressurized while passing through the nip portion N so that the toner image is fixed onto the recording material P.

As illustrated in FIG. 2, the fixing apparatus 100 is a roller fixing apparatus that presses the pressure roller 102 serving as a pressing rotary member against the fixing roller 101 serving as a fixing rotary member, to form a heating nip for the recording material P. The fixing apparatus 100 makes the fixing roller 101 and the pressure roller 102 longer in the longitudinal direction than a fixing apparatus corresponding to the A3 size because the maximum width of a usable recording material (sheet) is an elongated A3 size. Fixability of an image requires an adhesive strength between a fixed image and a recording material P while being uniform fixability ensured. In the fixing apparatus 100, the fixing roller 101 is provided with an elastic layer, to ensure a correspondence to various recording materials and an image quality.

In a case where the fixing roller 101 is configured by coating a core metal having a halogen heater 111 arranged in its inside with an elastic layer made of silicon rubber or fluoro rubber and forming a release layer made of fluororesin on the elastic layer, heat from the halogen heater 111 is blocked by the core metal and the elastic layer, and is not easily transferred onto a surface of the fixing roller 101. Therefore, a surface temperature easily drop during continuous image formation. However, in a case where the fixing roller 101 is configured by directly coating a core metal with a release layer without providing an elastic layer on the core metal, a surface temperature hardly drops during continuous image formation. However, the larger the thickness of the core metal becomes, the more greatly heat is blocked. Therefore, the surface temperature similarly drops. Further, in a case where there is no elastic layer, in a recording material having a large surface unevenness, a toner within a recess portion does not easily contact the fixing roller 101 and easily becomes inferior in fixability. Particularly in a color image, in not only uneven paper but also a smooth recording material, a surface of an unfixed image cannot be uniformly melted. Therefore, minute fixing unevenness and uneven gloss and color unevenness due to nonuniform melting may occur.

The fixing roller 101 is configured by overlapping a cylindrical core metal 101*a* made of a metal, a heat-resistant elastic layer 101*b*, and a heat-resistant release layer 101*c* in this order from its inside. The core metal 101*a* is made of aluminum having an outer diameter of 76 mm, a thickness of 6 mm, and a length of 350 mm. The elastic layer 101*b* is composed of silicon rubber having a thickness of 2 mm (a JIS-A hardness of 20 degrees), and coats an outer peripheral surface of the core metal 101*a*. The release layer 101*c* coats a surface of the elastic layer 101*b* to improve releasability from a toner. The release layer 101*c* is composed of fluororesin (e.g., a tetrafluoroethylene-perfluoroalkoxyethylene polymer (PFA) tube) having a thickness of 100 μm.

The pressure roller 102 is generally configured by coating a core metal made of a metal with a heat-resistant elastic layer made of silicon rubber or fluoro rubber and forming a heat-resistant release layer made of fluororesin or the like on the elastic layer. The pressure roller 102 is configured by overlapping a cylindrical core metal 102*a* made of a metal, a heat-resistant elastic layer 102*b*, and a heat-resistant release layer 102*c* in this order from its inside. The core metal 102*a* is made of stainless having an outer diameter of 54 mm, a thickness of 5 mm, and a length of 350 mm. The pressure roller 102 uses stainless having a higher rigidity than aluminum to prevent deflection. The elastic layer 102*b* is composed of silicon rubber having a thickness of 3 mm (having a JIS-A hardness of 24 degrees), and coats an outer peripheral surface of the core metal 102*a*. The release layer 102*c* coats a surface of the elastic layer 102*b* to improve releasability from a toner. The release layer 102*c* is composed of fluororesin (e.g., a PFA tube) having a thickness of 100 μm.

The halogen heater 111 having rated power of 1500 W, which generates heat by energization, is arranged as a heating source substantially throughout in an axial direction (longitudinal direction) of the fixing roller 101 inside the core 101*a* of the fixing roller 101. The halogen heater 111 heats the fixing roller 101 from its inside.

A thermistor 121 arranged in a sheet supply area detects a surface temperature of the fixing roller 101. The thermistor 121 may be of a contact type or a non-contact type with a detection target. A temperature control unit 140 controls ON/OFF of the halogen heater 111 based on a detected temperature by the thermistor 121, to control the surface temperature of the fixing roller 101 to a predetermined target temperature (e.g., 180° C.).

A pressure mechanism 170 presses the pressure roller 102 against the fixing roller 101 at predetermined pressure, to form a nip portion N serving as a press-contact portion between the pressure roller 102 and the fixing roller 101. The length in a circumferential direction of the nip portion N is approximately 10 mm. The fixing roller 101 is rotationally driven at a predetermined circumferential speed in a direction indicated by an arrow by a drive motor 145. An example of the predetermined speed is 230 mm/sec corresponding to productivity of 50 ppm in an A4-size lateral feed. The pressure roller 102 is driven to rotate by the rotation of the fixing roller 101 on which it abuts. In other words, the pressure roller 102 is rotatably driven by the rotation of the fixing roller 101.

The control unit 160 functioning as a selecting device (a control device) controls the pressure mechanism 170, to perform an operation for separating or crimping the pressure roller 102 from or to the fixing roller 101.

An image formation job means a task for executing printout or copying on one or more recording materials upon being instructed to be executed from an operation panel or an external input terminal or a set of receiving data such as image data constituting the task, data for designating a recording material, and the number of prints. When the image formation job is received, an image formation operation such as charging or exposure is started by waiting until the fixing apparatus 100 can receive a recording material. Alternatively, the image formation operation is started slightly ahead so that a recording material on which a toner image has been transferred reaches the fixing apparatus 100 at timing where the fixing apparatus 100 can receive the recording material.

On the other hand, the pressure roller 102 is separated from the fixing roller 101 during standby in which an image formation job to be executed at the moment is not instructed to be executed and is waited for. In a case where the fixing roller 101 and the pressure roller 102 remains not separated from but crimped to each other during the standby, an elastic layer of the fixing roller 101 and an elastic layer of the pressure roller 102 are locally deformed or distorted in the nip portion N. If the deformation or the distortion, which has occurred during the standby, also remains during printing, a transverse streak or a glossy streak (uneven gloss) may occur on a fixed image, resulting in a deteriorated image quality. Therefore, the fixing roller 101 and the pressure roller 102 can be separated from each other during the standby.

Since the nip portion N is formed to perform the fixing operation for the image on the recording material (heating processing for the recording material) during the printing from the start to the end of the image formation job, the pressure roller 102 is crimped to the fixing roller 101. Neither a deformation nor a distortion remaining even during the printing occurs in the respective elastic layers of the fixing roller 101 and the pressure roller 102 that are rotating.

More specifically, during power-on or during recovery from a sleep mode (hereinafter referred to as "during startup"), when the fixing roller 101 rises to a predetermined temperature to heat the pressure roller 102, the pressure roller 102 is crimped to the fixing roller 101 to rotate. The pressure roller 102, which has been separated from the fixing roller 101, starts to abut thereon to rotate while being heated from the fixing roller 101 via the crimping rotation.

Cooling Device

As illustrated in FIG. 2, during continuous printing, a portion of the fixing roller 101, which has dropped in temperature by losing heat to the recording material P in the nip portion N, is heated by an amount of heat from the halogen heater 111, to rise to a predetermined temperature. Then, heat is repeatedly given to the recording material P in the nip portion N again, to perform a fixing operation. At that time, the pressure roller 102 drops in temperature by losing heat to the recording material P in the nip portion N, and is heated by an amount of heat from the fixing roller 101 between recording materials. The amount of heat repeatedly increases and decreases, to perform a fixing operation while gradually rising in temperature. The pressure roller 102 does not have a heating source in its inside. When image formation is continuously performed, a surface temperature of the pressure roller 102 gradually rises upon receiving heat from the fixing roller 101 between the recording materials, to reach a predetermined temperature.

In recent years, the fixing apparatus 100 has been required to correspond to various recording materials such as thin paper, thick paper, rough paper (paper having a rough surface), uneven paper (embossed paper or the like), and coated paper (gloss coated paper, matt coated paper, etc.). The fixing apparatus 100 has been required to correspond to recording materials of large sizes such as 13 inches×19 inches exceeding the A3 size. In a recording material serving as thin paper of a large size such as 13 inches×19 inches (paper having a small basis weight), a poor image and a crease due to a conveyance performance of the fixing apparatus 100 easily occur. In the fixing apparatus 100 corresponding to large sizes, a standard of a conveyance performance request for a trailing-edge crease phenomenon and a side-edge corrugation phenomenon of the recording material becomes stricter than that in the conventional fixing apparatus. Therefore, in the fixing apparatus 100, the cooling fan 130 is controlled, to reduce both the trailing-edge crease phenomenon and the corrugation phenomenon.

As illustrated in FIG. 2, to cool the pressure roller 102, a cooling fan 130 functioning as a cooling device is arranged in a direction in which air is blown toward the pressure roller 102 below the pressure roller 102. The cooling fan 130 is connected to a duct (not illustrated), to let in air outside the image forming apparatus 20 and blow the air to the pressure roller 102.

As illustrated in FIG. 3, the cooling fan 130 is divided into four fans 130*a* to 130*d*, and the fans 130*a* to 130*d* can be independently turned on/off. The cooling fan 130 is not necessarily arranged below the pressure roller 102. If an object to cool the pressure roller 102 is attained, the cooling fan 130 may be arranged at the right/left of the pressure roller 102 (on the upstream side/downstream side in a conveyance direction of a recording material). More specifically, the cooling fan 130 includes the fans 130*b* and 130*c* bearing a function of cooling an area adjacent to a longitudinal center of the pressure roller 102 and the fans 130*a* and 130*d* bearing a function of cooling an area adjacent to longitudinal ends of the pressure roller 102.

A cooling control unit 150 controls ON/OFF of the four fans 130*a* to 130*d*, to change a cooling pattern in the longitudinal direction of the pressure roller 102. The cooling control unit 150 can optionally set a rotational speed of the fans

130*a* to 130*d* in a range of 100% to 0% (OFF). However, the fans 130*a* to 130*d* are controlled to be set to ON (100%) or OFF (0%) for ease of illustration.

Trailing-Edge Crease Phenomenon

Figure 11A:
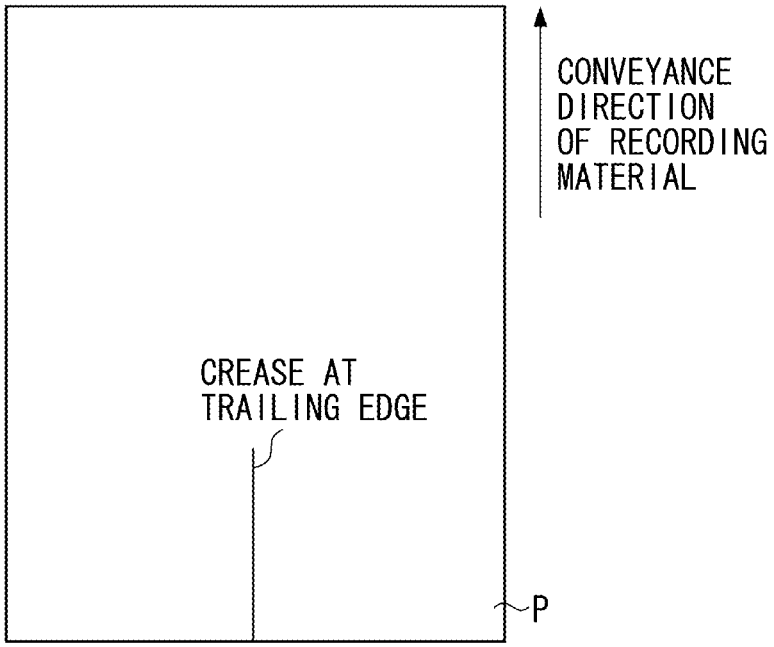
FIGS. 11A and 11B illustrate the occurrence of a trailing-edge crease.
Figure 11B:
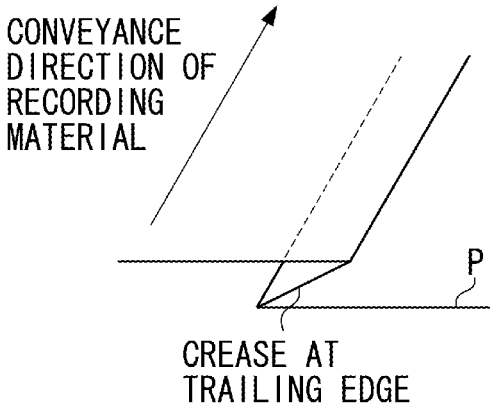

FIGS. 11A and 11B illustrate the occurrence of a trailing-edge crease. As illustrated in FIG. 11A, the trailing-edge crease phenomenon is a phenomenon that a center at a trailing edge of a recording material is creased. As viewed in enlarged fashion from the trailing edge of the recording material, the recording material is observed to be folded to make a crease, as illustrated in FIG. 11B. When two-sided printing is performed, the recording material is greatly curled so that a leading edge of the recording material is not easily smoothly inserted into the nip portion N. Therefore, the trailing-edge crease phenomenon can easily occur.

A corrugation phenomenon is a phenomenon that a recording material is corrugated when it is stressed at both right and left edges on the side of its trailing edge.

In a recording material serving as large-sized thin paper, a trailing-edge crease phenomenon and a corrugation phenomenon may easily occur. Stress causing the trailing-edge crease phenomenon and the corrugation phenomenon is exerted on the recording material so that an image is easily disturbed because a toner movement (a drag) in a surface direction occurs on a surface of the recording material even if the recording material does not lead to the trailing-edge crease phenomenon and the corrugation phenomenon.

The trailing-edge crease phenomenon easily occurs, when the recording material is conveyed in the nip portion N formed between the fixing roller 101 and the pressure roller 102, if a conveyance speed at both longitudinal ends of the nip portion N is lower than a conveyance speed at the longitudinal center thereof. In the trailing-edge crease phenomenon, stress directed toward the center is generated at a trailing edge of the recording material so that the recording material is folded at the trailing edge of the recording material, to make a crease extending in a conveyance direction. If the recording material does not lead to the trailing-edge crease phenomenon, streak-shaped density unevenness may occur in a halftone image or a black image having a maximum density.

The trailing-edge crease phenomenon easily occurs in a recording material having extremely large water content due to a high-humidity environment. In the high-humidity environment, water content in the recording material is large. Therefore, rigidity of the recording material decreases. When the rigidity of the recording material is low, recording materials easily overlap against stress directed toward the center in a conveyance width direction of the recording material. Therefore, the trailing-edge crease phenomenon easily occurs.

As described above, the pressure roller 102 is heated by being crimped to the fixing roller 101 to rotate. At this time, heat is greatly released into air at the both ends of the pressure roller 102. Therefore, the surface temperature of the pressure roller 102 is high at the center and low at the both ends. Accordingly, the paper conveyance speed at the longitudinal both ends of the nip portion N is lower than that at the longitudinal center thereof. Therefore, the trailing edge crease phenomenon easily occurs.

Therefore, the cooling control unit 150 turns on the fans 130*b* and 130*c* at the center and turns off the fans 130*a* and 130*d* at the both ends during standby after the end of startup in a case where image formation is performed on the recording material serving as the large-sized thin paper in a high-humidity environment. The center of the pressure roller 102 is cooled, to make the temperature at the center of the pressure roller 102 lower than that at the both ends thereof and make the conveyance speed at the both ends of the nip portion N higher than that at the center thereof, to prevent the trailing-edge crease phenomenon.

Corrugation Phenomenon

Figure 12A:
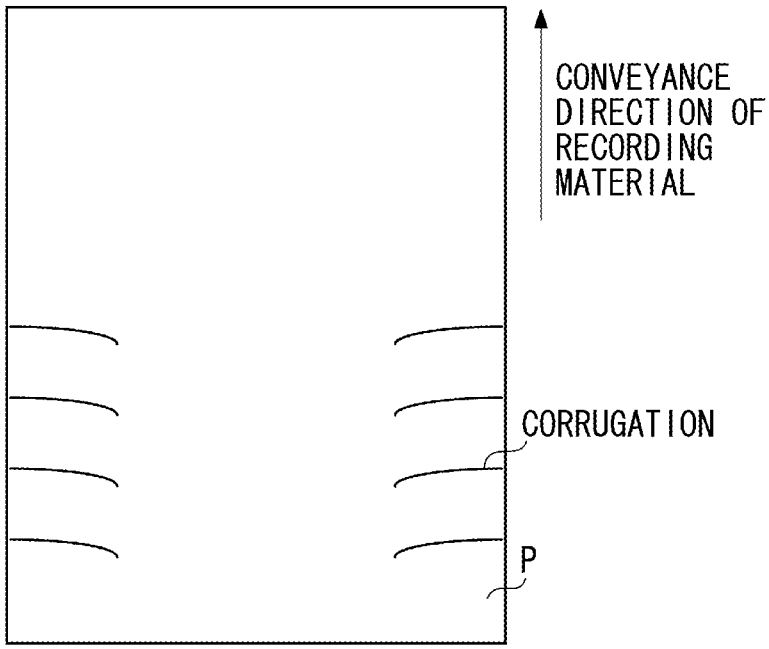
FIGS. 12A and 12B illustrate the occurrence of a corrugation.
Figure 12B:
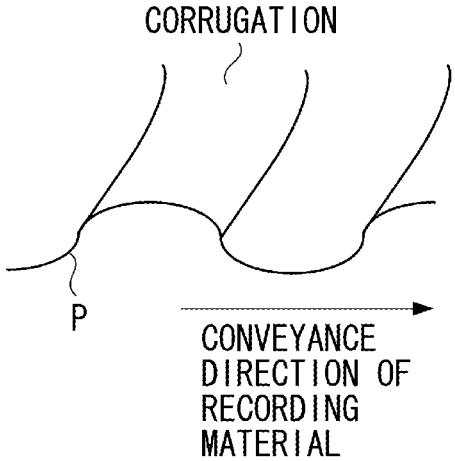

FIGS. 12A and 12B illustrate the occurrence of a corrugation. As described above, to prevent the trailing-edge crease phenomenon, the conveyance speed at the both ends of the nip portion N may be higher than the conveyance speed at the center of the nip portion N. However, if the trailing-edge crease phenomenon is too much prevented to make the conveyance speed at the both ends of the nip portion N too higher, the corrugation phenomenon easily occurs at this time. The corrugation phenomenon easily occurs, when the recording material is conveyed in the nip portion N formed by crimping the fixing roller 101 and the pressure roller 102, if the paper conveyance speed at the both ends of the nip portion N is higher than the conveyance speed at the center thereof.

As illustrated in FIG. 12A, the corrugation phenomenon is a phenomenon that both edges of a recording material are deformed and corrugated. As viewed in enlarged fashion from the edge of the recording material, the recording material is observed to be corrugated upon being stressed in a direction in which it is pulled outward from the edge, as illustrated in FIG. 12B.

If the corrugation phenomenon is great, corrugation causes not only a deformation of the recording material but also a variation of a toner scattering way in a halftone image. Therefore, density unevenness may occur.

The corrugation phenomenon easily occurs in a recording material having extremely small water content due to a low-humidity environment. The corrugation phenomenon easily occurs when large-sized thin paper is used for a recording material in a low-humidity environment having small water content. The water content in the recording material is small in the low-humidity environment. Therefore, the recording material does not more easily expand/contract than when the water content in the recording material is large in a high-humidity environment. Therefore, the recording material is corrugated because it cannot uniformly expand/contract by being stressed at its both ends in a width direction. The corrugation phenomenon occurs when a conveyance speed at the both ends of the pressure roller 102 is too higher than a conveyance speed at the center thereof in a rotational axis direction of the pressure roller 102. Stress is generated at both edges in the width direction of the recording material to be conveyed by the pressure roller 102, and the recording material is distorted due to the stress at the both edges, leading to the corrugation phenomenon.

(1) Stress exerted on the both edges in the width direction of the recording material is also generated by the excess of control to suppress the trailing-edge crease phenomenon. When the surface temperature of the pressure roller 102 is made too low at the center and too high at the both ends, the conveyance speed at the both longitudinal ends of the nip portion N is made too higher than that at the longitudinal center thereof so that the corrugation phenomenon occurs.

(2) Stress exerted on the both edges in the width direction of the recording material is also generated when image formation on a large-sized recording material is started subsequently to image formation on a small-sized recording material. The surface temperature at the both ends of the pressure roller 102 becomes high by passing of the small-sized recording material, and the conveyance speed at the both ends of the pressure roller 102 becomes excessive during passing of the large-sized recording material so that the corrugation phenomenon occurs.

(3) Stress exerted on the both edges in the width direction of the recording material is also generated when image formation on a recording material serving as thick paper is followed by image formation on a recording material serving as thin paper of the same size as that of the thick paper. In the recording material serving as the thick paper, the trailing-edge crease phenomenon does not basically occur. Therefore, fixing processing is performed while the surface temperature at the both ends of the pressure roller 102 is higher than usual by giving priority to an increase in an amount of heating (while a non-sheet passing portion greatly rises in temperature). When the image formation on the recording material serving as the thin paper is continuously started, therefore, the surface temperature at the both ends of the pressure roller 102 becomes higher than required, and the conveyance speed at the both ends of the pressure roller 102 becomes excessive so that the corrugation phenomenon occurs.

When such a recording material is printed, the two fans 130*a* and 130*d* at the both ends of the pressure roller 102 are turned on during the standby, to cool the both ends thereof. When the image formation job is received during standby shortly after the end of the previous image formation job, image formation is waited for a predetermined time to turn on only the fans 130*a* and 130*d* at the both ends of the pressure roller 102, to selectively cool the both ends thereof. Thus, the paper conveyance speed at the both longitudinal ends of the nip portion N is not too higher than that at the longitudinal center thereof, to prevent the corrugation phenomenon. The conveyance speed at the both longitudinal ends of the nip portion N is not too higher than that at the longitudinal center thereof, thereby not leading to the corrugation phenomenon.

A first exemplary embodiment will be described.

Figure 4:
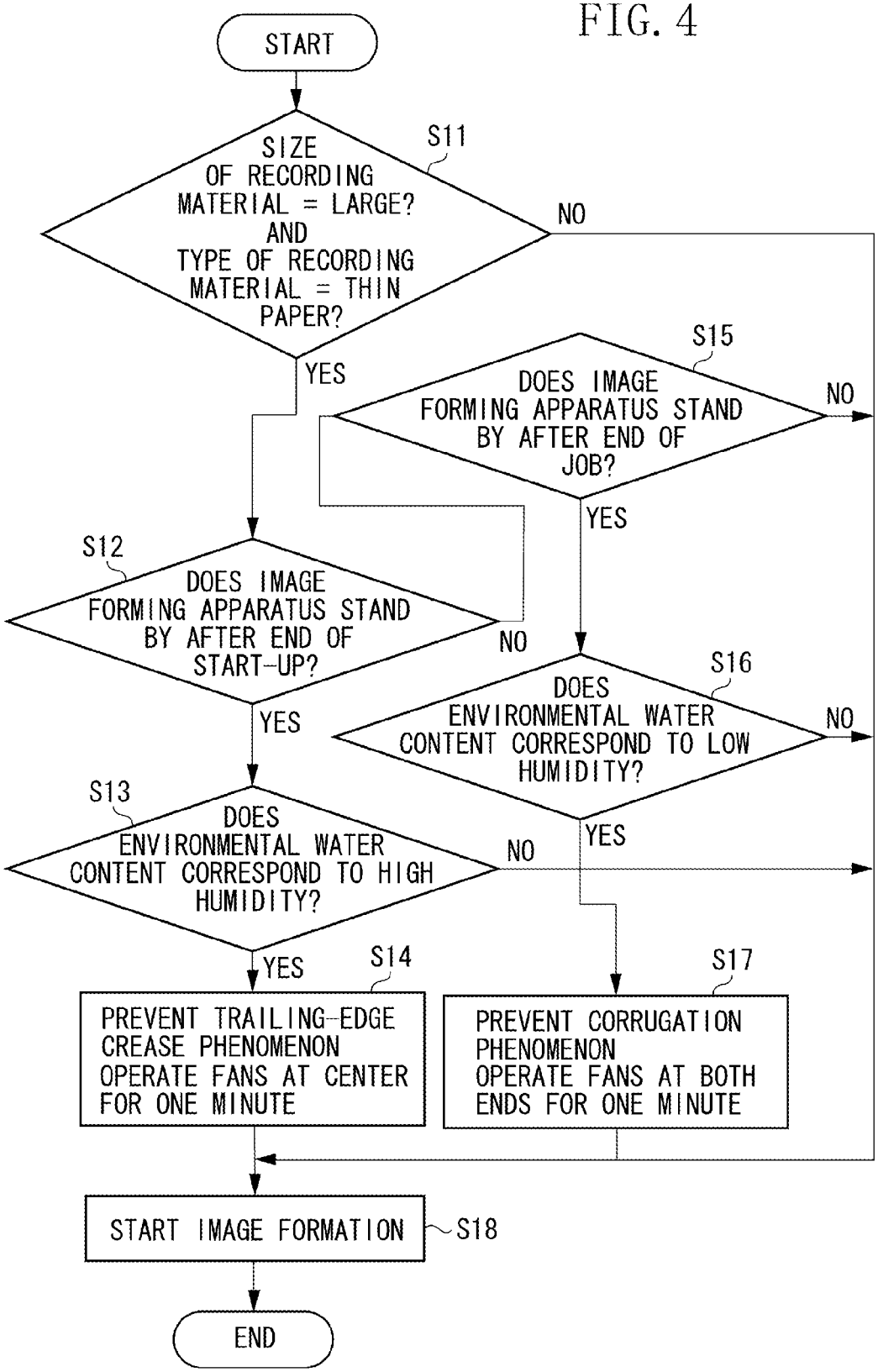
FIG. 4 is a flowchart of cooling control of a pressure roller in a first exemplary embodiment.

FIG. 4 is a flowchart of cooling control of the pressure roller 102 in the first exemplary embodiment. As illustrated in FIG. 2, the fixing roller 101 serving as an example of a heating rotary member is controlled to be heated to a predetermined temperature, to heat an image surface of a recording material. The pressure roller 102 serving as an example of a roller member includes the elastic layer 102*b*, and forms a nip portion N of the recording material between the pressure roller 102 and the fixing roller 101. The cooling fan 130 serving as an example of a cooling unit can cool the pressure roller 102 by making cooling performances for the center and the both ends in the rotational axis direction of the pressure roller 102 variably different.

As illustrated in FIG. 1, a temperature/humidity sensor 21 (atmosphere sensor) serving as an example of a third detection unit detects a temperature and humidity of environmental air of the recording material P. To evaluate an absolute humidity of the air, the temperature/humidity sensor 21 is arranged in the image forming apparatus 20.

The control unit 160 serving as an example of a selecting device selects and executes a first mode, a second mode, and a third mode. The control unit 160 implements measures serving as an example of the first mode against a corrugation phenomenon when water content (an absolute humidity) in atmospheric air (an ambient atmosphere) is small below a predetermined range, based on the output of the temperature/humidity sensor 21. The control unit 160 implements measures serving as the second mode against a trailing-edge crease phenomenon when the water content in the atmospheric air is large above the predetermined range, based on the output of the temperature/humidity sensor 21. The control unit 160 executes the third mode if the water content in the atmospheric air is within the predetermined range, based on the output of the temperature/humidity sensor 21. In the third mode, image formation is started without actuating the cooling fan 130.

The control unit 160 executes the first mode when the control unit 160 performs, subsequently to heating processing for continuous recording materials of the same size, heating processing for a predetermined recording material in which a corrugation phenomenon more easily occurs than the previous recording material. In the first mode, the control unit 160 starts image formation after making a cooling performance for the both ends of the pressure roller 102 higher than a cooling performance for the center thereof to actuate the cooling fan 130. A predetermined recording material in which a corrugation phenomenon easily occurs is a recording material having a larger length in a direction perpendicular to a conveyance direction than the previous recording materials and a recording material having a lower weight per unit area than the previous recording materials, as described above. The first mode is executed commonly for recording materials being of a predetermined size or more and having a predetermined basis weight or less so that the corrugation phenomenon does not occur even in the above described recording materials.

The control unit 160 executes the second mode to avoid the above-mentioned trailing-edge crease phenomenon if the control unit 160 starts image formation after waiting until the fixing roller 101 is heated from a room temperature state, to rise to a predetermined temperature. In the second mode, the image formation is started after a cooling intensity for the center of the pressure roller 102 is made higher than a cooling intensity for the both ends thereof to actuate the cooling fan 130.

The control unit 160 executes the third mode unless the length of the recording material in the direction perpendicular to the conveyance direction is a predetermined length or more and the weight per unit area of the recording material is less than a predetermined weight. An operator sets the size and the basis weight of a recording material via a monitor (not illustrated) of the image forming apparatus 20 when setting the recording material on the image forming apparatus 20. Thus, the control unit 160 in the image forming apparatus 20 recognizes the width and the basis weight of the recording material.

As illustrated in FIG. 4 with reference to FIG. 2, in step S11, the control unit 160 determines whether the size of a recording material is large and the type of the recording material is thin paper when it receives an image formation job. The recording material the size of which is large is a recording material having a width of 300 mm or more. The recording material the type of which is thin paper is a recording material having a weight per unit area (basis weight) of 105 [g/m$^2$] or less.

If the size of the recording material is large and the type of the recording material corresponds to thin paper (YES in step S11), then in step S12, the control unit 160 determines whether the image forming apparatus 20 corresponds to standby after the end of startup. Standby after the end of startup is a state where the image forming apparatus 20 stands by while image formation can be performed by turning on power to an image forming apparatus main body to raise a temperature of the fixing roller 101 from a room temperature to a fixable temperature.

If narrow paper having a width of less than 300 mm in which a trailing-edge crease phenomenon does not easily occur or thick paper having a weight per unit area (basis weight) of 106 [g/m$^2$] or more is printed (NO in step S11), then in step S18, the control unit 160 starts printing without making the printing wait.

If the image forming apparatus 20 stands by after the end of startup (YES in step S12), then in step S13, the control unit 160 calculates environmental water content from a temperature and humidity detected by the temperature/humidity sensor 21, to determine whether the environmental water content corresponds to a high humidity. The high humidity means a case where environmental water content (an absolute humidity) is 12 [g/(dry air)Kg] or more.

If the environmental water content corresponds to the high humidity (YES in step S13), then in step S14, the control unit 160 turns on the two fans 130*b* and 130*c* at the center of the pressure roller 102, to cool the center thereof for one minute. During the standby after the end of startup, a temperature at the center of the pressure roller 102 becomes high. Therefore, a temperature at the both ends of the pressure roller 102 is increased by cooling the center thereof, to prevent the trailing-edge crease phenomenon. In step S18, the control unit 160 makes the printing wait after the first mode is started, and starts the printing after the end of an operation of the cooling fans for one minute serving as an example of a predetermined time.

If the environmental water content is 12 [g/(dry air)Kg] or less (NO in step S13), then in step S18, the control unit 160 immediately starts the printing without making the printing wait. This is because in a case where water content in the recording material is small, the trailing-edge crease phenomenon does not easily occur.

If the image forming apparatus 20 does not stand by after the end of startup (NO in step S12), then in step S15, the control unit 160 determines whether the image forming apparatus 20 stands by after the end of printing of the previous job. If the image forming apparatus 20 stands by after the end of the printing of the previous job (YES in step S15), then in step S16, the control unit 160 calculates environmental water content from the temperature and humidity detected by the temperature/humidity sensor 21, to determine whether the environmental water content corresponds to a low humidity. The low humidity means a case where environmental water content (absolute humidity) is 6 [g/(dry air)Kg] or less.

If the environmental water content corresponds to the low humidity (YES in step S16), then in step S17, the control unit 160 turns on the two fans 130*a* and 130*d* at the both ends of the pressure roller 102, to cool the both ends thereof for one minute. During standby after the printing, a temperature at the both ends of the pressure roller 102 becomes high. Therefore, a temperature at the both ends of the pressure roller 102 is not too increased by cooling the both ends thereof, to prevent the corrugation phenomenon. In step S18, the control unit 160 makes the printing wait, and starts the printing after the end of an operation of the cooling fans for one minute.

If the environmental water content is 6 [g/(dry air)Kg] or more (NO in step S16), then in step S18, the control unit 160 immediately starts the printing without making the printing wait. This is because in a case where water content in the recording material is large, the corrugation phenomenon does not easily occur.

In the first exemplary embodiment, control is performed depending on the type of recording material and an environment, to prevent a trailing-edge crease phenomenon by cooling the center of the pressure roller 102 while making the printing wait only in a combination of a recording material and an environmental condition in which the trailing-edge crease phenomenon easily occurs. Thus, the trailing-edge crease phenomenon, which easily occurs immediately after the temperature of the fixing apparatus 100 is raised, can be prevented. This is more desirable because productivity can be improved without making the printing wait in a recording material or an environment in which the trailing-edge crease phenomenon does not easily occur.

In the first exemplary embodiment, control is performed depending on the type of recording material and an environment, to prevent a corrugation phenomenon by cooling the both ends of the pressure roller 102 while making the printing wait only in a combination of a recording material and an environmental condition in which the corrugation phenomenon easily occurs. Thus, the corrugation phenomenon, which easily occurs immediately after the previous job of the fixing apparatus 100 is printed. This is more desirable because productivity can be improved without making the printing wait in a recording material or an environment in which the corrugation phenomenon does not easily occur.

In the first exemplary embodiment, a temperature distribution in the rotational axis direction of the pressure roller 102 is corrected depending on the type of recording material and an environment during standby, to optimize a conveyance speed distribution in the rotational axis direction of the pressure roller 102 in the nip portion N during the printing.

The pressure roller 102 is coated with the elastic layer, and thermal expansion of the elastic layer differs with temperature. Therefore, a conveyance speed greatly varies with temperature. In a portion where the temperature of the pressure roller 102 is high, the outer diameter of the pressure roller 102 is more enlarged because the thermal expansion is great, and the conveyance speed is increased. In a portion where the temperature of the pressure roller 102 is low, the outer diameter of the pressure roller 102 is less enlarged because the thermal expansion is small, and the conveyance speed is reduced. A conveyance speed distribution of the recording material along the nip portion N can be appropriately adjusted by correcting the temperature distribution in the rotational axis direction of the pressure roller 102.

The fixing roller 101 is also coated with the elastic layer. Even if the temperature distribution in the rotational axis direction of the fixing roller 101 is adjusted, therefore, the conveyance speed distribution of the recording material along the nip portion N can be appropriately adjusted. However, a surface temperature of the fixing roller 101 more greatly affects fixability than the surface temperature of the pressure roller 102. When the temperatures at the center and the end in the rotational axis direction of the fixing roller 101 differ, a difference occurs in the fixability. Therefore, for example, uneven gloss of a fixed image occurs due to partial fixing failure and excessive fixing. Accordingly, the temperature distribution of the fixing roller 101 may be maintained as uniformly as possible, to make the fixability uniform.

In the first exemplary embodiment, the temperature distribution in the longitudinal direction of the pressure roller 102, which hardly affects the fixability, is adjusted to adjust the conveyance speed distribution of the recording material along the nip portion N. This is more desirable than when the temperature distribution in the longitudinal direction of the fixing roller 101 is adjusted.

A second exemplary embodiment will be described.

Figure 5:
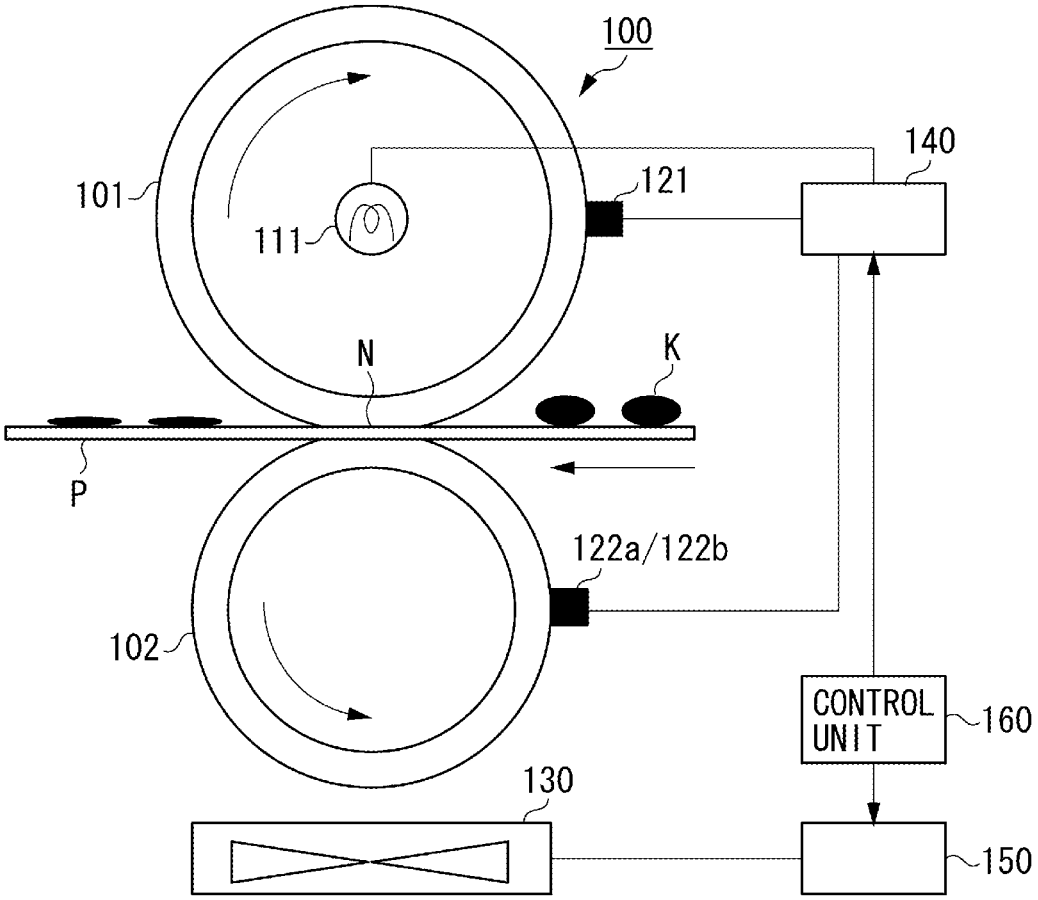
FIG. 5 illustrates a configuration of a fixing apparatus according to a second exemplary embodiment.

FIG. 5 illustrates a configuration of a fixing apparatus according to the second exemplary embodiment. FIG. 6 is a flowchart of cooling control of a pressure roller 102 in the second exemplary embodiment. While cooling fans are actuated only for a predetermined time in the first exemplary embodiment, cooling fans are actuated until a fixing roller enters a predetermined cooling state in the second exemplary embodiment.

As illustrated in FIGS. 5 and 3, a thermistor 122*a* serving as an example of a temperature sensor detects a temperature adjacent to a longitudinal center of a pressure roller 102. A thermistor 122*b* serving as an example of a temperature sensor detects a temperature adjacent to longitudinal ends of the pressure roller 102. The thermistor 122*a* is arranged to come into contact with the longitudinal center of the pressure roller 102. The thermistor 122*b* comes into contact with the outside of an area, with which an A4-size lateral feed recording material comes into contact, of the pressure roller 102, to detect an end temperature of the pressure roller 102. The thermistors 122*a* and 122*b* are connected to a temperature control unit 140 serving as a control device, to convert a detected voltage into a detected temperature. The thermistors 122*a* and 122*b* may be of a non-contact type arranged opposed to a detection target.

The control unit 160 executes a first mode when the detected temperature by the thermistor 122*b* is higher above a predetermined first temperature difference than the detected temperature by the thermistor 122*a* due to a rise in temperature of a non-sheet passing portion. In the first mode, a cooling performance for both ends of the pressure roller 102 is made higher than a cooling performance for the center thereof, to start image formation after the cooling fan 130 is actuated until the detected temperature by the thermistor 122*b* falls within a predetermined temperature range.

The control unit 160 executes a second mode when the detected temperature by the thermistor 122*b* is lower below a second temperature difference, which is smaller than the first temperature difference, than the detected temperature by the thermistor 122*a* because a rise in an end temperature of the pressure roller 102 is delayed. In the second mode, an amount of cooling at the center of the pressure roller 102 is made larger than an amount of cooling at the both ends thereof, to start image formation after the cooling fan 130 is actuated until the detected temperature by the thermistor 122*b* falls within the predetermined temperature range.

As illustrated in FIG. 5, in the second exemplary embodiment, the thermistors 122*a* and 122*b* are arranged to detect a surface temperature of the pressure roller 102. Since the other configuration is similar to that of the fixing apparatus 100 according to the first exemplary embodiment described with reference to FIG. 2. Therefore, in FIG. 5, portions common to those in the first exemplary embodiment are assigned common reference numerals to those illustrated in FIG. 2, and hence an overlapped description is not repeated.

A cooling control unit 150 evaluates the pressure roller 102, as described below, according to a temperature difference (TE−TC) between a center temperature TC detected by the thermistor 122*a* and an end temperature TE detected by the thermistor 122*b*.

(A) A trailing-edge crease phenomenon may occur: (TE−TC)≤3 [° C.]

(B) Neither a trailing-edge crease phenomenon nor a corrugation phenomenon occurs: 3 [° C.]<(TE−TC)≤13 [° C.]

(C) A corrugation phenomenon may occur: 13 [° C.]<(TE−TC)

For each of the above-mentioned conditions (A) to (C), the cooling control unit 150 selects cooling control of the pressure roller 102, to control the cooling fan 130, as described below.

(A) The cooling unit 150 cools the center of the pressure roller 102, to prevent the occurrence of the trailing-edge crease phenomenon. If the end temperature of the pressure roller 102 is lower than the center temperature thereof, a conveyance speed at both longitudinal ends of a nip portion N becomes lower than a conveyance speed at the longitudinal center thereof so that the trailing-edge crease phenomenon easily occurs. The cooling control unit 150 turns on the fans 130*b* and 130*c* at the center of the pressure roller 102, to cool the center thereof. The paper conveyance speed at the longitudinal both ends of the nip portion N is made higher than that at the longitudinal center thereof, to prevent the occurrence of the trailing-edge crease phenomenon.

(B) Printing is immediately started without performing the cooling control of the pressure roller 102. 3 [° C.]<(TE−TC)≤13 [° C.] is a target temperature difference range of the pressure roller 102. In the target temperature difference range, neither the trailing-edge crease phenomenon nor the corrugation phenomenon occurs.

(C) The both ends of the pressure roller 102 are cooled, to prevent the occurrence of the corrugation phenomenon. If the end temperature of the pressure roller 102 is excessively higher than the center temperature thereof, the conveyance speed at the longitudinal both ends of the nip portion N is excessively higher than the conveyance speed at the longitudinal center thereof, so that the corrugation phenomenon easily occurs. The cooling control unit 150 turns on the fans 130*a* and 130*d* at the both ends of the pressure roller 102, to cool the both ends thereof. The conveyance speed at the longitudinal both ends of the nip portion N is not excessively higher than that at the longitudinal center thereof, to prevent the occurrence of the corrugation phenomenon.

As illustrated in FIG. 6 with reference to FIG. 5, in step S21, the control unit 160 determines whether the size of a recording material is large and the type of the recording material is thin paper according to the above-mentioned standard when the control unit 160 receives an image formation job.

If the size of the recording material is large and the type of the recording material is thin paper (YES in step S21), then in step S22, the control unit 160 determines whether the pressure roller 102 corresponds to a condition of (TE−TC)≤3 [° C.] based on outputs of the thermistors 122*a* and 122*b*.

If the pressure roller 102 corresponds to the condition of (TE−TC)≤3 [° C.] (YES in step S22), then in step S23, the control unit 160 determines whether environmental water content corresponds to the above-mentioned condition of a high humidity.

If the environmental water content corresponds to the condition of the high humidity (YES in step S23), then in step S24, the control unit 160 turns on the fans 130*b* and 130*c* at the center of the pressure roller 102, to cool the center thereof.

In step S25, the control unit 160 determines whether the pressure roller 102 corresponds to the target temperature difference range 3 [° C.]<(TE−TC)≤13 [° C.]. If the pressure roller 102 is cooled until it corresponds to the target temperature difference range 3 [° C.]<(TE−TC)≤13 [° C.] (YES in step S25), then in step S27, the control unit 160 stops the cooling fan 130. In step S28, the control unit 160 starts the printing.

In step S29, the control unit 160 determines whether the pressure roller 102 corresponds to a condition of (TE−TC)>13 [° C.] based on the outputs of the thermistors 122*a* and 122*b*.

If the pressure roller 102 corresponds to the condition of (TE−TC)>13 [° C.] (YES in step S29), then in step S30, the control unit 160 determines whether the environmental water content corresponds to the above-described condition of a low humidity.

If the environmental water content corresponds to the condition of the low humidity (YES in step S30), then in step S31, the control unit 160 turns on the fans 130*a* and 130*d* at both the ends of the pressure roller 102, to cool the both ends thereof.

If the pressure roller 102 is cooled until it corresponds to the target temperature difference range 3 [° C.]<(TE−TC)≤13 [° C.] (YES in step S25), then in step S27, the control unit 160 stops the cooling fan 130. In step S28, the control unit 160 starts the printing.

Thus, when a print signal is input during standby, the printing is waited for, to start the printing after a difference between the detected temperatures by the thermistors 122*a* and 122*b* falls within the target temperature difference range, to prevent both the trailing-edge crease phenomenon and the corrugation phenomenon.

Even if the difference between the detected temperature has not fallen within the target temperature difference range 3 [° C.]<(TE−TC)≤13 [° C.] (NO in step S25), then in step S26, the control unit 160 determines whether one minute has elapsed since the actuation of the cooling fan 130 was started. If one minutes has elapsed since the operation of the cooling fan 130 was started (YES in step S26), then in step S27, the control unit 160 stops the cooling fan 130. In step S28, the control unit 160 starts the printing. The control unit 160 sets a timeout time to one minute, to make the printing wait for a maximum of one minute, and forcibly starts the printing at the time point where a printing waiting time is one minute. The timeout time is a time enough to fall within the target temperature difference range by an operation of the cooling fan 130. Therefore, a concern that productivity is deteriorated because a printing start time swings due to a variation in tolerance of a component such as a thermistor can be eliminated.

In the second exemplary embodiment, if narrow paper or thick paper is printed, like in the first exemplary embodiment (NO in step S21), then in step S28, the control unit 160 immediately starts the printing without making the printing wait. Even if the pressure roller 102 corresponds to the condition of (TE−TC)≤3 [° C.] in which the trailing-edge crease phenomenon easily occurs, if the environmental water content does not correspond to the condition of the high humidity (NO in step S23), then in step S28, the control unit 160 immediately starts the printing without making the printing wait. Even if the pressure roller 102 corresponds to the condition of (TE−TC)>13 [° C.] in which the corrugation phenomenon easily occurs, if the environmental water content does not correspond to the condition of the low humidity (NO in step S30), then in step S28, the control unit 160 immediately starts the printing without making the printing wait.

Thus, control is performed depending on the type of recording material and an environment, to make the printing wait only in a combination of a recording material and an environmental condition in which the trailing-edge crease phenomenon or the corrugation phenomenon easily occurs. In the other case, the printing is immediately started without making the printing wait, to improve the productivity.

Comparison with First Embodiment

In the first exemplary embodiment, the temperature of the pressure roller 102 cannot be detected. Therefore, the cooling fan 130 is operated for a predetermined time. This is prediction control. Thus, the conveyance speed difference between the longitudinal ends and the longitudinal center of the nip portion N cannot be controlled with high accuracy by grasping an actual temperature distribution of the pressure roller 102.

During standby after the end of startup processing (warming-up processing), for example, the temperature distribution in the longitudinal direction of the pressure roller 102 differs depending on whether the temperature of the fixing roller 101 rises from a room temperature or rises from a high temperature close to a fixing temperature (target temperature). If the cooling fan 130 is equally operated for one minute, an insufficient decrease in the center temperature of the pressure roller 102 occurs in the former case, and an excessive decrease in the center temperature of the pressure roller 102 occurs in the latter case. Therefore, the trailing-edge crease phenomenon cannot be prevented, or the corrugation phenomenon may end up occurring.

During the standby after the end of the printing, for example, the temperature distribution in the longitudinal direction of the pressure roller 102 differs depending on the number of prints in the previous job and the size of the recording material. If the cooling fan 130 is equally operated for one minute, an insufficient decrease or an excessive decrease in the temperature at the both ends of the pressure roller 102 occurs. Therefore, the corrugation phenomenon cannot be prevented, or the trailing-edge crease phenomenon may end up occurring.

In the second exemplary embodiment, the thermistors 122*a* and 122*b* accurately grasp the temperature distribution in the longitudinal direction of the pressure roller 102, and actuates the cooling fan 130 only for a necessary and sufficient time, to control the temperature difference between the center and the ends of the pressure roller 102 to a desired temperature range. Thus, the trailing-edge crease phenomenon and the corrugation phenomenon can be more accurately prevented with higher accuracy than that in the first exemplary embodiment.

A modified example of the second exemplary embodiment will be described.

In the second exemplary embodiment, the threshold value of the target temperature difference range is determined to be fixed values of 3° C. and 13° C. However, the threshold value of the target temperature difference range may be changed depending on the size (the width or the length) of a recording material or the paper type (basis weight or quality of material) of the recording material, or an absolute humidity calculated from an ambient temperature/humidity outside the image forming apparatus 20. This is more desirable because a temperature distribution in a longitudinal direction of the pressure roller 102 can be more appropriately controlled so that productivity can be improved.

More specifically, a trailing-edge crease phenomenon and a corrugation phenomenon easily occur in a recording material having a basis weight less than a basis weight of plain paper: 80 [g/m$^2$]. Therefore, a threshold value of a target temperature difference range is determined to be 3° C. and 13° C. that are equal to those in the second exemplary embodiment. However, the trailing-edge crease phenomenon and the corrugation phenomenon hardly occur in a recording material having a basis weight equal to or more than the basis weight of the plain paper: 80 [g/m$^2$] compared to a recording material having a basis weight less than the basis weight: 80 [g/m$^2$]. Therefore, the threshold value of the target temperature difference range is enlarged and determined to 0° C. and 16° C. Thus, the frequency of actuating the cooling fan 130 is reduced, and the frequency of delaying the start of printing during the printing is reduced, resulting in improved productivity.

When the threshold value of the target temperature difference range is determined, the size (the width or the length) or the paper type (basis weight or quality of material) of a recording material printed immediately before transition to a standby state may be used. During standby after printing a recording material having a basis weight less than the basis weight of the plain paper: 80 [g/m$^2$], for example, the threshold value of the target temperature difference range is set to 3° C. (a threshold value for a paper crease) and 13° C. (a threshold value for paper corrugation). During the standby after printing a recording material having a basis weight equal to or more than the basis weight of the plain paper: 80 [g/m$^2$], the threshold value of the target temperature difference range is set to 0° C. (a threshold value for paper crease) and 16° C. (a threshold value for paper corrugation). In this case, there is an advantage in which the printing may be less delayed during intermittent printing of recording materials of the same type.

However, the image forming apparatus 20 enters the standby state after printing a recording material having a basis weight equal to or more than the basis weight of the plain paper: 80 [g/m$^2$]. When a recording material having a basis weight less than the basis weight of the plain paper: 80 [g/m$^2$] is then printed, the printing is slightly made to wait. Therefore, the printing may be delayed. Therefore, the above-described setting may be made for a user who frequently uses a use form of intermittently printing recording materials of the same type.

A third exemplary embodiment will be described.

Figure 7:
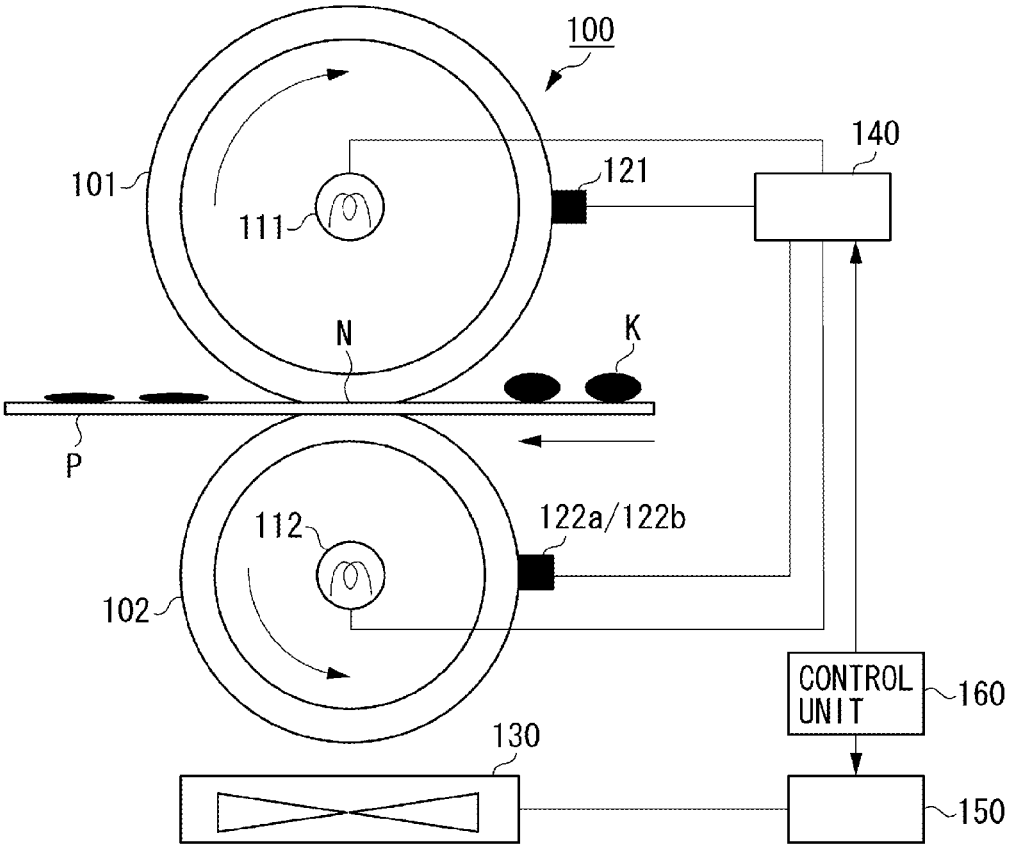
FIG. 7 illustrates a configuration of a fixing apparatus according to a third exemplary embodiment.
Figure 8:
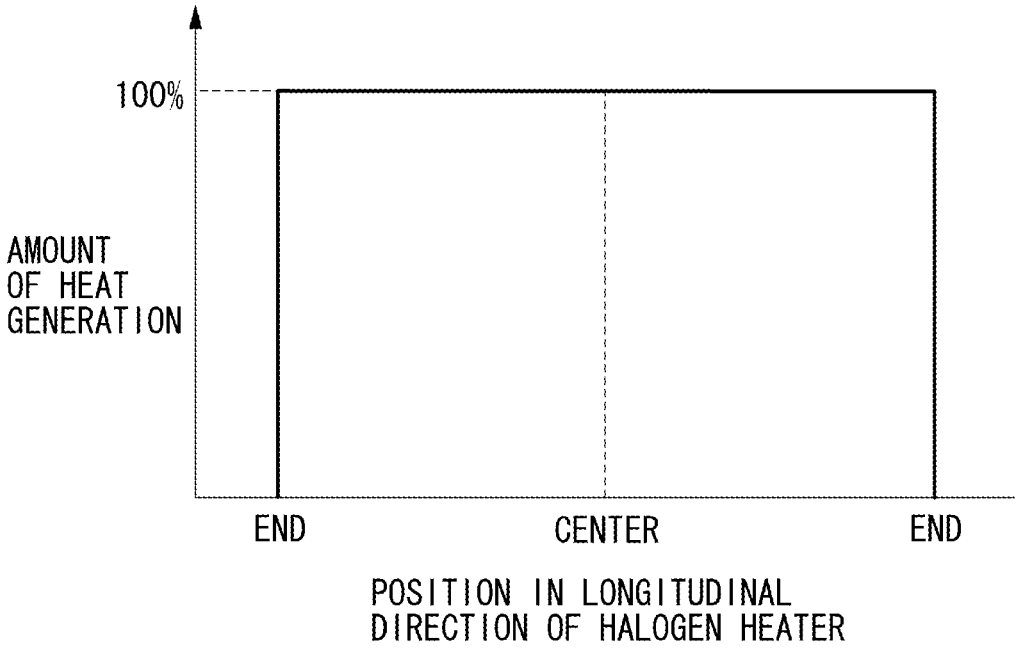
FIG. 8 illustrates a heat generation distribution characteristic of a halogen heater.

FIG. 7 illustrates a configuration of a fixing apparatus according to the third exemplary embodiment. FIG. 8 illustrates a heat generation distribution characteristic of a halogen heater 112. In the first and second exemplary embodiments, the temperature distribution in the longitudinal direction of the pressure roller 102 has been adjusted by relying on only the cooling fans. On the other hand, in the third exemplary embodiment, a halogen heater 112 serving as a heating device arranged inside a pressure roller 102 and a cooling fan 130 cooperate with each other, to adjust a temperature distribution in a longitudinal direction of the pressure roller. The other configuration is similar to that of the fixing apparatus according to the second exemplary embodiment described with reference to FIG. 5. Therefore, in FIG. 7, portions common to those in the second exemplary embodiment are assigned common reference numerals illustrated in FIG. 5, and hence an overlapped description is not repeated.

As illustrated in FIG. 7, in the third exemplary embodiment, the halogen heater 112 is arranged inside a core metal of the pressure roller 102. The halogen heater 112 having rated power of 400 W, which generates heat by energization, is arranged substantially throughout in a rotational axis direction (longitudinal direction) of the pressure roller 102. A temperature control unit 140 performs control to turn on/off the halogen heater 112 so that a surface temperature of the pressure roller 102 becomes a predetermined target temperature (100° C.) during fixing processing, based on a detected temperature by a thermistor 122*a* arranged at the center in the rotational axis direction of the pressure roller 102, as illustrated in FIG. 3.

As illustrated in FIG. 8, the halogen heater 112 uses a heater having a uniform heat generation distribution in the longitudinal direction. The halogen heater 112 heats the pressure roller 102 from its inside, to maintain the pressure roller 102 at a predetermined temperature even during standby in which the pressure roller 102 is separated from a fixing roller 101 so that a temperature variation in a nip portion N at the start of printing can be reduced. The pressure roller 102 is maintained at a predetermined temperature even during the printing so that fixability of an image to a recording material can be kept constant from early stages of the printing to the end of the printing. A surface temperature difference between the fixing roller 101 and the pressure roller 102 can be reduced, so that there is an advantage in which particularly thin paper may be less curled.

A cooling control unit 150 evaluates the pressure roller 102, as described below, according to a temperature difference (TE−TC) between a center temperature TC detected by the thermistor 122*a* and an end temperature TE detected by a thermistor 122*b*, like in the second exemplary embodiment.

(A) A trailing-edge crease phenomenon may occur: (TE−TC)≤3 [° C.]

(B) Neither a trailing-edge crease phenomenon nor a corrugation phenomenon occurs: 3 [° C.]≤(TE−TC)≤13 [° C.]

(C) A corrugation phenomenon may occur: 13 [° C.]<(TE−TC)

For each of the above-mentioned conditions (A) to (C), the cooling control unit 150 controls a cooling fan 130 and the halogen heater 112, as described below.

(A) The cooling control unit 150 turns on fans 130*b* and 130*c* at the center while temporarily changing a target temperature of the halogen heater 112 from 100° C. to 110° C. When an end temperature of the pressure roller 102 is lower than a center temperature at the center thereof, a conveyance speed at longitudinal both ends of the nip portion N becomes lower than a conveyance speed at the longitudinal center thereof, so that the trailing-edge crease phenomenon easily occurs. Therefore, the cooling control unit 150 turns on the fans 130*b* and 130*c* at the center, to reduce a conveyance speed at the longitudinal center of the pressure roller 102. Simultaneously, the cooling control unit 150 temporarily changes the target temperature of the pressure roller 102 from 100° C. to 110° C., to turn on the halogen heater 112, and raise the temperature at both ends of the pressure roller 102. Thus, a difference between the detected temperatures by the thermistors 122*a* and 112*b* transits to a target temperature difference range in a short time. At the time point where the difference between the detected temperatures has transited to the target temperature difference range, the cooling control unit 150 returns the target temperature of the pressure roller 102 to 100° C., to start fixing processing.

(B) The cooling control unit 150 keeps the target temperature of the halogen heater 112 at 100° C., not to actuate the cooling fan 130. If the difference between the detected temperatures by the thermistors 122*a* and 122*b* is in the target temperature difference range, neither the trailing-edge crease phenomenon nor the corrugation phenomenon easily occurs. Therefore, the temperature distribution in the rotational axis direction of the pressure roller 102 need not to be adjusted using the cooling fan 130.

(C) The cooling control unit 150 turns on fans 130*a* and 130*d* at the both ends while changing the target temperature of the halogen heater 112 from 100° C. to 110° C. When the end temperature of the pressure roller 102 is excessively higher than the center temperature thereof, the conveyance speed at the longitudinal both ends of the nip portion N becomes excessively higher than the conveyance speed at the longitudinal center thereof, so that the corrugation phenomenon easily occurs. Therefore, the cooling control unit 150 turns on the fans 130*a* and 130*d* at the both ends, to reduce a conveyance speed at the longitudinal both ends of the pressure roller 102. Simultaneously, the cooling control unit 150 temporarily changes the target temperature of the pressure roller 102 from 100° C. to 110° C., to turn on the halogen heater 112, and raise the temperature at the longitudinal center of the pressure roller 102. Thus, the difference between the detected temperatures by the thermistors 122*a* and 112*b* transits to the target temperature difference range in a short time. At the time point where the difference between the detected temperatures has transited to the target temperature difference range, the cooling control unit 150 returns the target temperature of the pressure roller 102 to 100° C., to start fixing processing.

Comparison with Second Exemplary Embodiment

In the second exemplary embodiment, when the cooling fans 130*b* and 130*c* at the center are actuated, wind reaches portions other than a cooling portion, to cool the both ends of the fixing roller 101 to generate temperature decrease. Therefore, it takes time for the temperature difference (TE−TC) to transit to the target temperature difference range. When the cooling fans 130*a* and 130*d* at the both ends are actuated, wind reaches the portions other than the cooling portion, to cool the center of the fixing roller 101 to generate temperature decrease. Therefore, it takes time for the temperature difference (TE−TC) to transit to the target temperature difference range.

On the other hand, in the third exemplary embodiment, in an area, which is not desired to be cooled, of the pressure roller 102, the halogen heater 112 is turned on, to positively raise a temperature of the area. An area, which is desired to be cooled, of the pressure roller 102 is cooled using the cooling fan 130 having an air quantity of air/wind speed sufficient to cool the area even if the halogen heater 112 is turned on. Thus, a printing waiting time can be shortened by making the temperature difference (TE−TC) reach the target temperature difference range in a short time. Therefore, the productivity of the image forming apparatus 20 is improved. Actually, a period of time elapsed until the temperature difference (TE−TC) reaches the target temperature difference range is required to be a maximum of one minute in the second exemplary embodiment while a period of time elapsed until the temperature difference (TE−TC) reaches the target temperature difference range is shortened to a maximum of 40 seconds in the third exemplary embodiment.

A fourth exemplary embodiment will be described.

Figure 9:
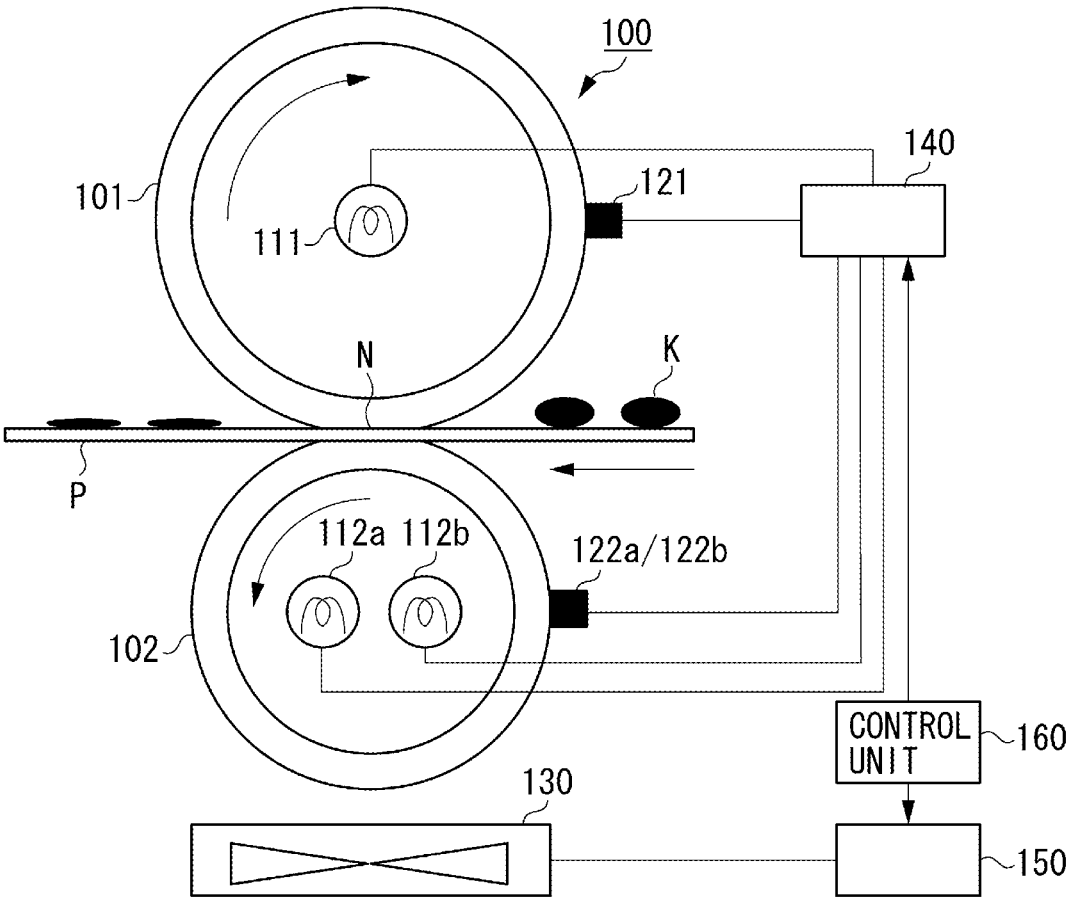
FIG. 9 illustrates a configuration of a fixing apparatus according to a fourth exemplary embodiment.
Figure 10A:
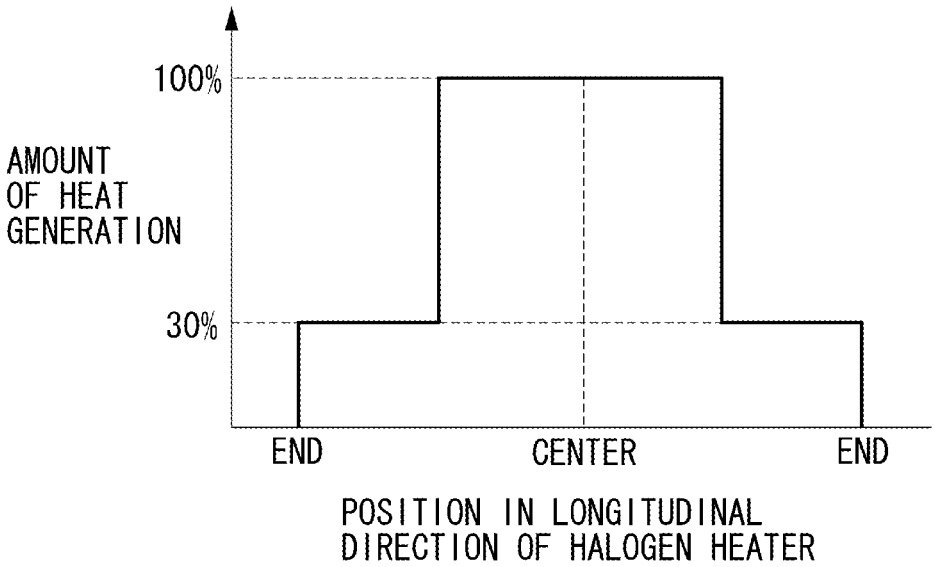
FIGS. 10A and 10B illustrate a heat generation distribution characteristic of a halogen heater.
Figure 10B:
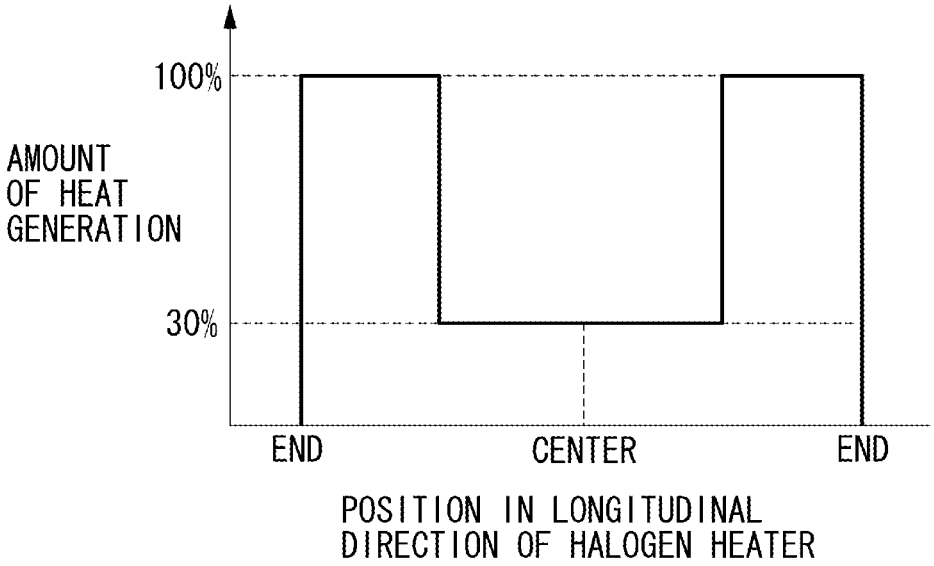

FIG. 9 illustrates a configuration of a fixing apparatus according to the fourth exemplary embodiment. FIGS. 10A and 10B illustrate a heat generation distribution characteristic of a halogen heater 112. In the third exemplary embodiment, the halogen heater 112, which uniformly heats the entire pressure roller 102 in the rotational axis direction, is arranged inside the pressure roller 102. On the other hand, in the fourth exemplary embodiment, two types of halogen heaters, which differ in heat generation distribution characteristic in a rotational axis direction, are arranged inside a pressure roller. The other configuration is similar to that of the fixing apparatus according to the third exemplary embodiment described with reference to FIG. 7. Therefore, in FIG. 9, portions common to those in the third exemplary embodiment are assigned common reference numerals to those illustrated in FIG. 7, and hence an overlapped description is not repeated.

As illustrated in FIG. 9, halogen heaters 112*a* and 112*b* serving as an example of a heating unit can heat a pressure roller 102 by making heating performances corresponding to the center and both ends in a rotational axis direction of the pressure roller 102 respectively differ in two stages. A control unit 160 makes the heating performance corresponding to the center of the pressure roller 102 higher than the heating performance corresponding to the both ends thereof during execution of a first mode, to actuate the halogen heaters 112*a* and 112*b*. The control unit 160 makes the heating performance corresponding to the both ends of the pressure roller 102 higher than the heating performance corresponding to the center thereof during execution of a second mode, to actuate the halogen heaters 112*a* and 112*b*.

In the fourth exemplary embodiment, the halogen heater 112*a* having rated power of 400 W and the halogen heater 112*b* having rated power of 400 W are arranged substantially throughout in the rotational axis direction (longitudinal direction) of the pressure roller 102 inside a core metal of the pressure roller 102. A temperature control unit 140 performs control to turn on/off the halogen heaters 112*a* and 112*b* so that a surface temperature of the pressure roller 102 falls within a predetermined target temperature, based on a detected temperature by a thermistor 122*a* arranged at the center of the pressure roller 102.

As illustrated in FIG. 10A, the halogen heater 112*a* is a center high-heat-generating heater having a heat generation distribution characteristic in which an amount of heat generation at the center of the pressure roller 102 is set larger than an amount of heat generation at both the ends thereof. As illustrated in FIG. 10B, the halogen heater 112*b* is an end high-heat-generating heater having a heat generation distribution characteristic in which an amount of heat generation at the both ends of the pressure roller 102 is set larger than an amount of heat generation at the center thereof. The halogen heaters 112*a* and 112*b* are complementarily designed so that if both the heaters are simultaneously turned on, a heat generation amount distribution in the longitudinal direction of the pressure roller 102 becomes uniform.

A cooling control unit 150 evaluates the pressure roller 102, as described below, according to a temperature difference (TE−TC) between a center temperature TC detected by the thermistor 122*a* and an end temperature TE detected by a thermistor 122*b*.

(A) A trailing-edge crease phenomenon may occur: (TE−TC)≤3 [° C.]

(B) Neither a trailing-edge crease phenomenon nor a corrugation phenomenon occurs: 3 [° C.]<(TE−TC)≤13 [° C.]

(C) A corrugation phenomenon may occur: 13 [° C.]<(TE−TC)

For each of the above-mentioned conditions (A) to (C), the cooling control unit 150 controls a cooling fan 130 and the halogen heaters 112*a* and 112*b*, as described below.

(A) The cooling control unit 150 turns on fans 130*b* and 130*c* at the center while turning off the halogen heater 112*a*, to change a target temperature for temperature adjustment by the halogen heater 112*b* from 100° C. to 110° C. When an end temperature of the pressure roller 102 is lower than a center temperature at the center thereof, a conveyance speed at both longitudinal ends of a nip portion N becomes lower than a conveyance speed at the longitudinal center thereof so that the trailing-edge crease phenomenon easily occurs. Therefore, the cooling control unit 150 turns on the fans 130*b* and 130*c* at the center, to reduce a conveyance speed at the longitudinal center of the pressure roller 102. Simultaneously, the cooling control unit 150 changes a target temperature of the pressure roller 102 from 100° C. to 110° C., to turn on the halogen heater 112*b*, and selectively raise the temperature at the both end of the pressure roller 102. Thus, a difference between the detected temperatures by the thermistors 122*a* and 112*b* transits to a target temperature difference range in a shorter time than that in the third exemplary embodiment.

(B) The cooling control unit 150 keeps the target temperature for temperature adjustment by the halogen heaters 112*a* and 112*b* at 100° C., not to actuate the cooling fan 130. If the difference between the detected temperatures by the thermistors 122*a* and 122*b* is in the target temperature difference range, neither the trailing-edge crease phenomenon nor the corrugation phenomenon easily occurs. Therefore, the temperature distribution in the rotational axis direction of the pressure roller 102 need not to be adjusted using the cooling fan 130.

(C) The cooling control unit 150 turns on fans 130*a* and 130*d* at the both ends while turning off the halogen heater 112*b*, to change the target temperature in temperature adjustment by the halogen heater 112*a* from 100° C. to 110° C. When the end temperature of the pressure roller 102 is excessively higher than the center temperature thereof, the conveyance speed at the longitudinal both ends of the nip portion N becomes excessively higher than the conveyance speed at the longitudinal center thereof, so that the corrugation phenomenon easily occurs. Therefore, the cooling control unit 150 turns on the fans 130*a* and 130*d* at the both ends, to reduce a conveyance speed at the longitudinal both ends of the pressure roller 102. Simultaneously, the cooling control unit 150 changes the target temperature of the pressure roller 102 from 100° C. to 110° C., to turn on the halogen heater 112, and raise the center temperature of the pressure roller 102. Thus, the difference between the detected temperatures by the thermistors 122*a* and 122*b* transits to the target temperature difference range in a shorter time than that in the third exemplary embodiment.

In the fourth exemplary embodiment, in a combination of a recording material and an environmental condition in which the trailing-edge crease phenomenon easily occurs, the halogen heaters 112*a* and 112*b* and the cooling fan 130 are controlled, to make the end temperature of the pressure roller 102 higher than the center temperature thereof. Thus, the conveyance speed at the longitudinal both ends of the nip portion N is made higher than the conveyance speed at the longitudinal center thereof, to prevent the trailing-edge crease phenomenon.

In the fourth exemplary embodiment, in a combination of a recording material and an environmental condition in which the corrugation phenomenon easily occurs, the halogen heaters 112*a* and 112*b* and the cooling fan 130 are controlled, not to make the end temperature of the pressure roller 102 too higher than the center temperature thereof. Thus, the conveyance speed at the longitudinal both ends of the nip portion N is not made too higher than the conveyance speed at the longitudinal center thereof, to prevent the corrugation phenomenon.

In the fourth exemplary embodiment, in a case corresponding to the above-described condition (A), only the halogen heater 112*b* adjusts the temperature of the pressure roller 102. Therefore, the halogen heater 112*a* does not heat a portion, to be cooled by the fans 130*b* and 130*c* at the center, of the pressure roller 102. On the other hand, the halogen heater 112*b* intensively heats the longitudinal both ends, which desires to raise the temperature to increase the conveyance speed, of the pressure roller 102. Thus, the temperature difference (TE−TC) reaches the target temperature difference range in a shorter time than that in the third exemplary embodiment, so that printing can be started.

In the fourth exemplary embodiment, in a case corresponding to the above-describe condition (C), only the halogen heater 112*a* adjusts the temperature of the pressure roller 102. Therefore, the halogen heater 112*b* does not heat a portion, to be cooled by the fans 130*a* and 130*b* at the both ends, of the pressure roller 102. On the other hand, the halogen heater 112*a* intensively heats the longitudinal center, which desires to raise the temperature to increase the conveyance speed, of the pressure roller 102. Thus, the temperature difference (TE−TC) reaches the target temperature difference range in a shorter time than that in the third exemplary embodiment so that printing can be started.

Actually, a period of time elapsed until the temperature difference (TE−TC) reaches the target temperature difference range is required to be a maximum of 40 seconds in the third exemplary embodiment. On the other hand, a period of time elapsed until the temperature difference (TE−TC) reaches the target temperature difference range is shortened to a maximum of 20 seconds in the fourth exemplary embodiment. A printing waiting time can be further shortened, so that the productivity of the image forming apparatus 20 can be increased.

A modified example of the fourth exemplary embodiment will be described.

If there is enough power in the image forming apparatus 20, control is performed to turn on/off the both halogen heaters 112*a* and 112*b* in parallel, so that the surface temperature of the pressure roller 102 can be adjusted to a target temperature of 100° C., like in the fourth exemplary embodiment. However, in recent years, power saving of the image forming apparatus 20 has been promoted, so that there may be no enough power. In this case, when control is performed to turn on/off the halogen heaters 112*a* and 112*b* simultaneously in parallel, total power may increase to exceed rated power.

If the thermistor 122*a* detects that the surface temperature of the pressure roller 102 is less than 100° C., both the halogen heaters 112*a* and 112*b* are alternately turned on, to prevent the halogen heaters 112*a* and 112*b* from being simultaneously turned on. While the halogen heater 112*a* is turned on/off for two seconds, the halogen heater 112*b* is turned off/on for two seconds. The halogen heaters 112*a* and 112*b* are alternately turned on by time division, so that the temperature of the pressure roller 102 is adjusted to a target temperature of 100° C.

When the thermistor 122*a* detects that the surface temperature of the pressure roller 102 is equal to or more than 100° C., both the halogen heaters 112*a* and 112*b* are turned off. This is more desirable and serves energy saving because the halogen heaters 112*a* and 112*b* only consume power of the same 400 W as that in the conventional technique even if there are two heaters.

Other Exemplary Embodiments

While an example of the roller fixing apparatus has been described in the first to fourth exemplary embodiments, the present invention can be similarly implemented even in a belt type fixing apparatus using a belt member as a fixing rotary member. While an example in which heating is performed using a halogen heater has been described in the first to fourth exemplary embodiments, the present invention can also be implemented in a fixing apparatus using a resistance heating device or a heating source of an electromagnetic induced heating method. While an example in which the pressure roller is cooled using the cooling fan as a cooling device has been described in the first to fourth exemplary embodiments, the present invention can be implemented using various types of cooling units regardless of whether the cooling unit is of a contact type or a non-contact type if it is one capable of locally cooling a pressure roller, for example, a heat pipe.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-159458 filed Jul. 18, 2012, which is hereby incorporated by reference herein in its entirety.

What is claimed is:

1. A fixing apparatus comprising:

a heating rotary member and a pressing rotary member configured to fix a toner image on a sheet in a nip portion therebetween;

a first cooling device configured to cool an area adjacent to a longitudinal center of the pressing rotary member;

a second cooling device configured to cool an area adjacent to longitudinal ends of the pressing rotary member;

a detecting device configured to detect a temperature and a humidity of an ambient atmosphere; and a controller configured to control operations of the first cooling device and the second cooling device based on an absolute humidity determined using the temperature and the humidity detected by the detecting device, wherein in a case where fixing processing is performed on a sheet having a maximum width usable for the fixing apparatus and having a basis weight of less than a predetermined value, the controller executes a first mode in which the fixing processing is started after the first cooling device is actuated for a predetermined time without actuating the second cooling device when the absolute humidity is equal to or larger than a first value and executes a second mode in which the fixing processing is started after the second cooling device is actuated for a predetermined time without actuating the first cooling device when the absolute humidity is equal to or smaller than a second value which is smaller than the first value.

2. The fixing apparatus according to claim 1, wherein the controller immediately starts the fixing processing without actuating the first cooling device and the second cooling device when the absolute humidity detected by the detecting device is larger than the second value and smaller than the first value.

3. The fixing apparatus according to claim 1, further comprising:

a heating device configured to heat the pressing rotary member;

a temperature sensor configured to detect a temperature adjacent to a longitudinal center of the pressing rotary member; and a control device configured to control, in response to an output of the temperature sensor, the heating device, wherein in a case where the pressing rotary member is cooled in the first mode and the second mode, a target temperature of the pressing rotary member is temporarily increased.

4. The fixing apparatus according to claim 1, wherein each of the first cooling device and the second cooling device includes a fan.

5. The fixing apparatus according to claim 1, wherein the pressing rotary member is a pressure roller.

* * * * *